US007482289B2

(12) United States Patent
Yonker et al.

(10) Patent No.: US 7,482,289 B2
(45) Date of Patent: Jan. 27, 2009

(54) METHODS AND APPARATUS FOR DEPOSITING TANTALUM METAL FILMS TO SURFACES AND SUBSTRATES

(75) Inventors: Clement R. Yonker, Kennewick, WA (US); Dean W. Matson, Kennewick, WA (US); John T Bays, West Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 194 days.

(21) Appl. No.: 11/511,548

(22) Filed: Aug. 25, 2006

(65) Prior Publication Data

US 2008/0050916 A1 Feb. 28, 2008

(51) Int. Cl.
*H01L 21/00* (2006.01)

(52) U.S. Cl. ..... 438/798; 438/681; 427/582; 257/E21.586

(58) Field of Classification Search ..... 438/681, 438/798, 800, 685, 909; 427/252, 582, 509, 427/444; 257/E21.586, E21.48, E21.479, 257/E21.478
See application file for complete search history.

(56) References Cited

U.S. PATENT DOCUMENTS

| | | | | |
|---|---|---|---|---|
| 6,715,498 | B1 * | 4/2004 | Humayun et al. | 134/1.3 |
| 6,884,737 | B1 * | 4/2005 | Blackburn et al. | 438/758 |
| 7,294,528 | B2 * | 11/2007 | Xu et al. | 438/99 |
| 2003/0152813 | A1 | 8/2003 | Paz de Araujo et al. | |
| 2004/0126485 | A1 * | 7/2004 | Thompson et al. | 427/126.5 |
| 2004/0202956 | A1 * | 10/2004 | Takahashi et al. | 430/270.1 |
| 2005/0269703 | A1 | 12/2005 | Dunn et al. | |
| 2006/0035014 | A1 * | 2/2006 | DeYoung et al. | 427/58 |
| 2006/0099348 | A1 * | 5/2006 | Narushima et al. | 427/444 |
| 2007/0235319 | A1 * | 10/2007 | Cerio, Jr. | 204/192.1 |
| 2007/0259111 | A1 * | 11/2007 | Singh et al. | 427/248.1 |

FOREIGN PATENT DOCUMENTS

| | | | |
|---|---|---|---|
| GB | 934545 | A | 8/1963 |
| WO | 0132951 | A2 | 5/2001 |
| WO | 0205329 | A2 | 1/2002 |
| WO | 2005013331 | A2 | 2/2005 |
| WO | 2006105466 | A2 | 10/2008 |

OTHER PUBLICATIONS

PCT International Search Report and Written Opinion.
Sekimoto, et al., A Novel MO Precursor for Metal Tantalum and Tantalum Nitride Film, Mater.Res.Soc.Symp.Proc., vol. 914, (2006), pp. 161-166 (XP008086732).
Bitterwolf, et al., Journal of Organometallic Chemistry 557 (1998) pp. 77-92.
Linehan, et al, J. Am. Chem Soc. 1998, vol. 120, pp. 5826-5827.
Li, Jian, The Focused-Ion Beam Microscope, JOM: Mar. 2006, vol. 58 # 3, ABI/INFORM Trade & Industry, pp. 27-31.

* cited by examiner

*Primary Examiner*—Caridad M Everhart
(74) *Attorney, Agent, or Firm*—James D. Matheson

(57) ABSTRACT

Methods and an apparatus are disclosed for depositing tantalum metal films in next-generation solvent fluids on substrates and/or deposition surfaces useful, e.g., as metal seed layers. Deposition involves low valence oxidation state metal precursors soluble in liquid and/or compressible solvent fluids at liquid, near-critical, or supercritical conditions for the mixed precursor solutions. Metal film deposition is effected via thermal and/or photolytic activation of the metal precursors. The invention finds application in fabrication and processing of semiconductor, metal, polymer, ceramic, and like substrates or composites.

39 Claims, 12 Drawing Sheets

METHODS AND APPARATUS FOR DEPOSITING TANTALUM METAL FILMS TO SURFACES AND SUBSTRATES

FIELD OF THE INVENTION

The present invention relates generally to methods and an apparatus for deposition of metal films. More particularly, the invention relates to methods and an apparatus for deposition of tantalum metal films to surfaces and substrates. The instant invention finds application in commercial processes including, e.g., semiconductor chip fabrication, metal surface processing and finishing, and like industrial applications.

BACKGROUND OF THE INVENTION

Semiconductor chips used in a multitude of electronic devices are composites fabricated from materials including semiconductors, dielectrics, metals, metal oxides, and patterned films. For example, semiconductor chip interconnects require deposition of metals in the feature patterns (e.g., vias) of the chip. Currently, deposition of tantalum films (e.g., tantalum metal, tantalum nitride, and the like) is of interest for preparation of, e.g., diffusion barriers and/or cap layers during semiconductor fabrication.

Various deposition methods are well known in the technical art including, e.g., Chemical Vapor Deposition (CVD), Physical Vapor Deposition (PVD) also known as Sputter Deposition, and Atomic Layer Deposition (ALD). Tantalum (Ta) precursors based upon the (+5) oxidation state of the tantalum metal have been reported for use in CVD. These organometallic tantalum precursors are selected from the common chemical classes of Ta (V) ethoxides or Ta (V) methoxides and derivatives; Ta (V) pentabromide or Ta (V) pentafluoride and derivatives; and most recently, Ta (V) pentakis dimethylamide compounds have been used. However, these precursors, including the Ta (V) ethoxides and methoxides, are incompatible with next generation solvents (e.g., carbon dioxide), reacting at room or higher temperatures forming undesirable precipitates and/or reaction products. Accordingly, new processes that provide for deposition of tantalum films compatible with next generation solvents are needed.

SUMMARY OF THE INVENTION

In one aspect, a method is disclosed providing for deposition of tantalum-bearing films to surfaces and substrates using precursors compatible with next generation solvents, comprising the steps: providing a substrate having a selected surface(s) disposed in thermal communication with a heating source(s); providing a tantalum-bearing precursor soluble in a solvent fluid comprised of at least one compressible-gas or liquid forming a solution; effecting a temperature on the surface(s) or substrate(s) to a temperature at or above a decomposition ($T_d$) or release temperature for the precursor with the heating source(s); exposing the surface(s) and/or substrate(s) to the precursor solution at a liquid, near-critical, or supercritical fluid condition for the precursor; and whereby tantalum released from the precursor is deposited as a metal film on the selected surface(s) and/or substrate(s).

In another aspect, an apparatus is disclosed for deposition of metal films to surfaces and substrates, the apparatus comprising: a reaction chamber operable for receiving a solvent fluid(s), a metal precursor(s), and/or other reagents and maintaining the solvent fluid, including reagents introduced thereto, at liquid, near-critical, or supercritical conditions for the solvent fluid; a heating source within the chamber operable for heating a substrate(s), including surface(s) thereof; optionally including a cooling source operable in conjunction with the heating source for regulating temperatures of the fluids, precursor(s), and/or reagents introduced thereto, and the substrate(s), including surface(s) thereof, within the chamber; wherein the heating and the cooling sources within the chamber are disposed in thermal communication with the substrate, surface(s) thereof, and the fluid(s) when introduced to the chamber, effecting a temperature on the surface(s) and/or the substrate(s) at or above a decomposition ($T_d$) or release temperature for the precursor(s), thereby exposing the surface(s) and/or substrate(s) to the precursor; and whereby metals released from the precursor(s) are deposited as a metal film on the selected surface(s) and/or substrate(s).

In one embodiment, the substrate is an electronic substrate selected from semiconductor chips, silicon wafers, or the like.

In another embodiment, the substrate comprises materials selected from metals, ceramics, polymers, and combinations thereof.

In another embodiment, the substrate comprises metals or metal layers.

In another embodiment, tantalum metal deposited to a surface(s) and/or a substrate(s) is used as a metal finish for an article of manufacture, e.g., a gun barrel in a metal finishing process.

In another embodiment, the substrate comprises a ceramic selected from tantalum nitride (TaN), silicon carbide (SiC), and like materials, and combinations thereof.

In another embodiment, the substrate comprises a polymer selected from the group consisting of low-k dielectrics, organosilane glass (OSG), siloxanes, methylsilsesquioxanes, polysiloxanes, and the like, and combinations thereof.

In another embodiment, the substrate comprises an organic polymer.

In another embodiment, the substrate includes a surface(s) selected from the group consisting of two-dimensional, three-dimensional, and combinations thereof.

In another embodiment, the surface(s) is a metal surface(s), ceramic surface(s), polymer surface(s), and combinations thereof.

In another embodiment, the surface(s) is a feature surface(s) selected from the group of vias, wells, trenches, gaps, holes, interconnects, the like, and combinations thereof.

In another embodiment, heat source(s) for heating the fluid for thermal decomposition of the precursor are selected from the group of infra-red source(s), microwave source(s), convective source(s), resistive source(s), radiofrequency (RF) source(s), ultrasonic source(s), mechanical source(s), chemical source(s), and combinations thereof.

In another embodiment, the solvent fluid comprises compressible gases selected from the group of carbon dioxide, ethane, ethylene, propane, butane, sulfurhexafluoride, ammonia, or the like, and combinations thereof.

In another embodiment, the solvent fluid comprises carbon dioxide at a pressure selected in the range from about 830 psi (56.48 atm) to about 10,000 psi (680.48 atm), or from about 1500 psi (102.07 atm) to about 5,000 psi (340.24 atm), or from about 2250 psi (153.11 atm) to about 3,000 psi. (204.14 atm).

In another embodiment, the tantalum-bearing precursor is a chemical compound of the form $[(Cp)(Ta)(CO)_{4-N}(L_N)]$, wherein (Cp) is a cyclopentadienyl ($C_5H_5$) ring or a cyclopentadienyl ring functionalized with up to 5 identical or different R-groups (e.g., $C_5R_5$). R-groups are not limited. Exemplary R-groups include, but are not limited to, e.g., hydrogen (H), alkanes (e.g., methanes, ethanes, propanes, etc.) or alkyls (e.g., methyl, ethyl, propyl, phenyl, etc.), alkenes (e.g., ethylenes, propylenes, etc.) or alkenyls (e.g., ethenyl ($CH_2$═CH—), propenyl, benzyl ($C_6H_5CH_2$—), and etc.), alkynes (ethynes (CH≡C—), propynes, etc.), and combinations thereof. (CO) denotes carbonyl ligands, where N is a number from 0 to 4. ($L_N$) denotes a number (N) of identical or different ligands (L), e.g., ethylene, where N is a number of from 0 to 4. In other embodiments, other suitable ligands (L) may be employed, e.g., photolabile ligands, photolytically-releasable ligands, photolytically-exchangeable ligands, or photolytically-sensitive ligands.

In another embodiment, the tantalum-bearing precursor is a chemical compound of the form $[(In)(Ta)(CO)_{4-N}(L_N)]$, wherein (In) is an indenyl ($C_9H_7$) polycyclic hydrocarbon, composed of a benzene ring fused with a cyclopentene ring, or an indenyl functionalized with up to 7 identical or different R-groups (i.e., $C_9R_7$). R-groups are not limited. Exemplary R-groups include, but are not limited to, e.g., hydrogen (H), alkanes (e.g., methanes, ethanes, propanes, etc.) or alkyls (e.g., methyl, ethyl, propyl, phenyl ($C_6H_5$), etc.), alkenes (e.g., ethylenes, propylenes, etc.) or alkenyls (e.g., ethenyl ($CH_2$═CH—), propenyl, benzyl ($C_6H_5CH_2$—), and etc.), alkynes (ethynes (CH≡C—), propynes, etc.), and combinations thereof. (CO) denotes carbonyl ligands, where N is a number from 0 to 4. ($L_N$) denotes a number (N) of identical or different ligands (L), e.g., ethylene, where N is a number of from 0 to 4. In other embodiments, other suitable ligands (L) may be employed, e.g., photolabile ligands, photolytically-releasable ligands, photolytically-exchangeable ligands, or photolytically-sensitive ligands.

In another embodiment, the tantalum-bearing precursor is selected from $(Cp)Ta(CO)_4$ or $(In)Ta(CO)_4$. Here (Cp) is a cyclopentadienyl ($C_5H_5$) ring or functionalized cyclopentadienyl ring ($C_5R_5$); (In) is an indenyl ($C_9H_7$) polycyclic hydrocarbon, or functionalized indenyl (i.e., $C_9R_7$), comprised of up to 7 identical or different R-groups. R-groups are not limited. (CO) denotes carbonyl ligands.

In another embodiment, the tantalum-bearing precursor is premixed in a liquid solvent, and subsequently introduced to a compressible gas solvent fluid, effecting deposition of the metal film to a surface(s) and/or substrate(s).

In one embodiment, benzene is used as a liquid solvent.

In another embodiment, an alkanol is used as a liquid solvent, e.g., methanol.

In another embodiment, mixtures of compressible fluid solvents and/or liquid solvents are used.

In another embodiment, tantalum released from the tantalum-bearing precursor has a valence of (+1).

In another embodiment, tantalum released from the tantalum-bearing precursor has a valence other than (+5).

In another embodiment, providing comprises introducing the precursor in a substantially solid form and introducing the solvent fluid thereafter dispersing the precursor yielding a precursor solution and exposing the surface(s) thereto.

In another embodiment, providing comprises premixing the precursor in a solvent fluid and introducing the premixed precursor solution to a deposition or reaction chamber exposing the deposition surface(s) and/or substrate(s) thereto.

In another embodiment, the premixed precursor is introduced batch-wise to a deposition or reaction chamber, exposing the deposition surface(s) and/or substrate(s) thereto.

In another embodiment, the premixed precursor is introduced substantially continuously to a deposition or reaction chamber, exposing the deposition surface(s) and/or substrate(s) thereto.

In another embodiment, the providing comprises introducing the precursor in a substantially solid form to a deposition or reaction chamber and introducing the solvent fluid thereafter dispersing the precursor therein yielding a precursor solution, exposing the deposition surface(s) and/or substrate(s) thereto.

In another embodiment, temperature of the heating source(s) and/or surface is selected in the range from the decomposition temperature ($T_d$) to about 600° C., or from the decomposition temperature ($T_d$) to about 400° C., or from the decomposition temperature ($T_d$) to about 350° C.

In another embodiment, tantalum film deposited on a deposition surface(s) is reduced using a reducing agent.

In another embodiment, the reducing agent used is hydrogen introduced at a stoichiometric excess in the solvent fluid.

In another embodiment, the reducing agent used is an alcohol from the group of n-alkanols.

In another embodiment, the reducing agent is an n-alkanol selected from methanol, ethanol, and/or n-propanol.

In another embodiment, the tantalum film deposited on the deposition surface(s) is substantially uniform.

In another embodiment, a tantalum film deposited on a surface(s) is a component of a binary, tertiary, quaternary, or higher order film, composite, or structure that includes components including, but not limited to, e.g., OSG, Ru, $Ta_2O_5$, TaN, Cu, SiC, and the like, and combinations thereof.

In another embodiment, a tantalum film deposited on a surface(s) is used in the preparation of a diffusion barrier, e.g., TaN, during manufacturing of microelectronic devices.

In another embodiment, a tantalum film is deposited on a surface as a seed layer during manufacturing of a semiconductor chip or wafer.

In another embodiment, release of tantalum from a tantalum-bearing precursor is controlled photolytically via removal of one or more photolabile ligands (L) of the precursor in conjunction with a photolytic source.

In another embodiment, photolytic source(s) used for photolytic decomposition of the precursor include members of the group of visible (VIS) source(s), ultra-violet (UV) source(s), ultra-violet/visible (UV/VIS) source(s), laser source(s), and combinations thereof.

In another embodiment, one or more photolabile ligands of a tantalum-bearing precursor are exchanged with a substituent ligand(s) using a photolytic source prior to release of tantalum therefrom, effecting change(s) in release properties (e.g., temperature of release) of the tantalum-bearing precursor and thus deposition conditions of the metal film to a surface(s) and/or substrate.

In another embodiment, release of tantalum from a tantalum-bearing precursor is effected thermally and photolytically in conjunction with a heating source(s) and a photolytic source(s).

DETAILED DESCRIPTION

Figure 1:
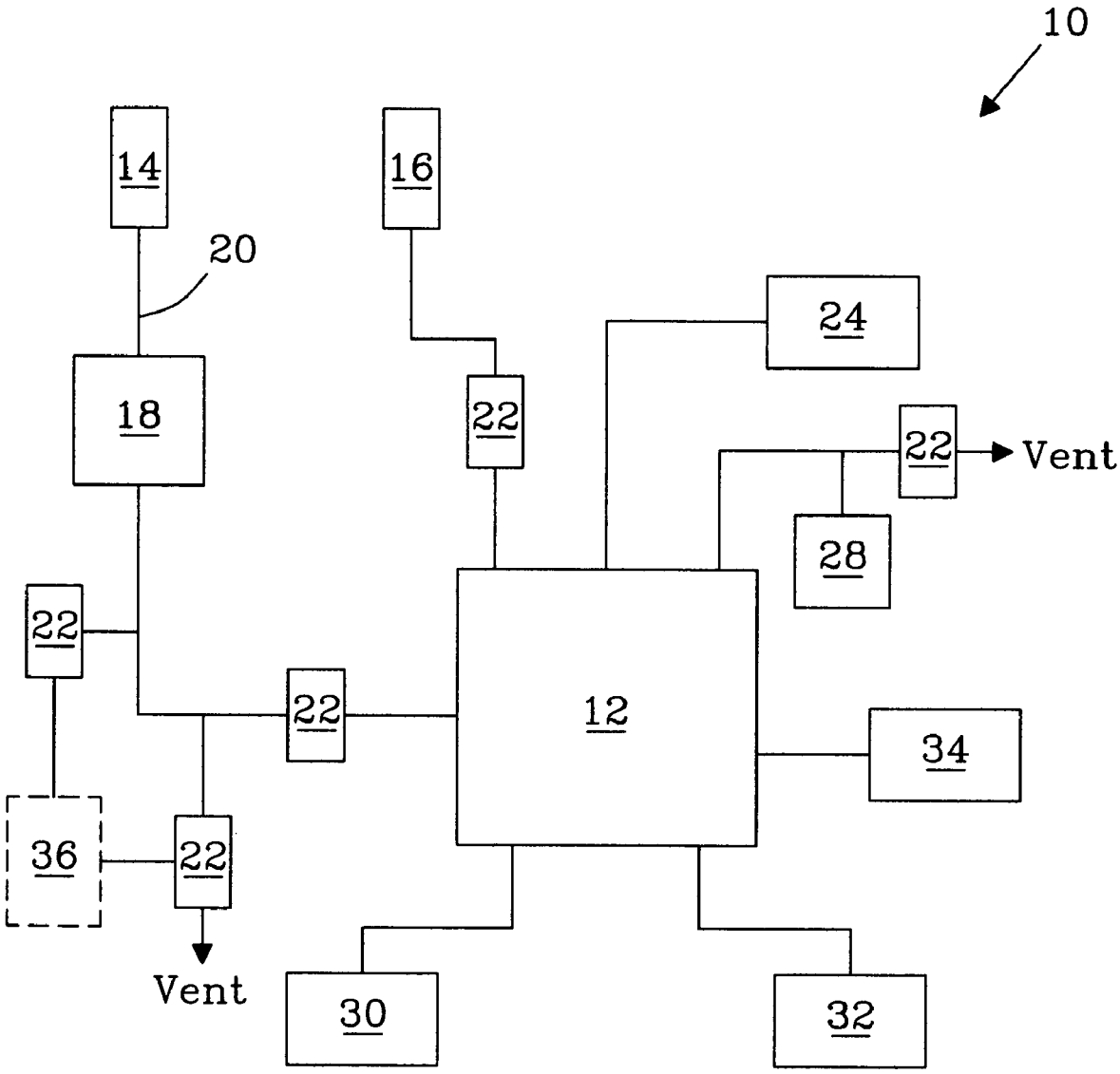
FIG. 1 illustrates a complete deposition system of a bench-scale design for depositing tantalum metal films on a surface(s) or substrate.

The present invention relates generally to methods for selective deposition of metals, termed chemical fluid deposition (CFD). More particularly, the invention relates to methods for chemical fluid deposition of tantalum to substrates and/or surfaces, i.e., CFD-Ta. The instant invention finds application in such commercial applications as e.g., semiconductor chip fabrication, metal article fabrication, metal surfacing and finishing.

The term "substrate" as used herein means a base, or underlying, material to which metals and/or additional materials or layers are deposited. Substrates include, but are not limited to, e.g., electronic substrates, metal substrates, ceramic substrates, polymer substrates, and the like, or combinations thereof. Electronic substrates include, but are not limited to, e.g., semiconductors, chips, wafers, and substrates comprised of silicon, and the like, or combinations thereof. Substrates may be comprised substantially of a single or primary material or alternatively of two or more materials selected from, e.g., metals, ceramics, polymers, and the like, or combinations thereof. Ceramics include, e.g., silicon carbide (SiC) and tantalum nitride (TaN), but are not limited. Polymers include, e.g., organosilane glass (OSG), low-k dielectrics, siloxanes, methylsilsesquioxanes, polysiloxanes, and other polymers selected from major classes of inorganic, organic, and hybrid polymers. As such, composition is not limited. Structure of substrates is also not limited. For example, materials and layers of a substrate may be of any arrangement, order (e.g., sequential, hierarchical, etc.), and/or pattern as suits the intended application, article of manufacture, or composition of matter. For example, semiconductor substrates typically comprise silicon, but may comprise, e.g., sapphire in cases where radiation resistance is important, such as military applications.

The term "OSG substrate" as used herein means a substrate coupon tested in conjunction with the invention comprising of a silicon wafer prepared with a first surface layer of organosilane glass (OSG) dielectric.

The term "surface" as used herein refers to any substrate boundary where deposition of a tantalum metal film is desired. Surfaces include, but are not limited to, e.g., two-dimensional surfaces (e.g., horizontal surfaces, vertical surfaces, flat surfaces), three dimensional surfaces, feature surfaces (e.g., vias, wells, channels, trenches, interconnects), compound or complex surfaces, as well as surfaces including, e.g., metal surfaces, polymer surfaces, ceramic surfaces, and the like, or combinations thereof. No limitations are intended.

The terms "substituents" and "constituents" as used herein refer to atoms or groups of atoms that can exchange with ligands and/or functional groups present in a precursor molecule. Hydrocarbon substituents include, but are not limited to, e.g., alkyls, alkenyls, and alkynyls.

The term "alkyl" means a monovalent, unbranched or branched hydrocarbon chain having no double bonds therein, derived from an alkane molecule by removing one hydrogen atom, e.g., methyl ($CH_3$) and ethyl ($C_2H_5$), derived from their parent alkanes, i.e., methane ($CH_4$) and ethane ($C_2H_6$), respectively. In some cases different alkyl groups can be formed from the parent alkane by removing a different hydrogen atom along the chain, e.g., 1-propyl or n-propyl ($CH_2CH_2CH_3$), and 2-propyl or isopropyl [$CH(CH_3)_2$], both formed from propane ($CH_3CH_2CH_3$). When a functional group is joined with an alkyl group, replacing the hydrogen that was removed, a compound is formed whose characteristics depend largely on the functional group. Alkyl groups include, but are not limited to, e.g., $C_2$-$C_8$ alkyl groups such as methyl, ethyl, propyl, butyl, pentyl, hexyl, and like substituents. Alkyl groups can be unsubstituted or substituted with one or more substituents.

The term "alkenyl" means a monovalent, unbranched or branched hydrocarbon chain having one or more double bonds therein. The double bond of an alkenyl group can be unconjugated or conjugated to another unsaturated group. Alkenyl groups include, but are not limited to, e.g., $C_2$-$C_8$ alkenyl groups such as vinyl, butenyl, pentenyl, hexenyl, and like moieties (e.g., butadienyl, pentadienyl, hexadienyl, 2-ethylhexenyl, 2-propyl-2-butenyl, 4-(2-methyl-3-butene)-pentenyl). Alkenyl groups can be unsubstituted or substituted with one or more substituents.

The term "alkynyl" means a monovalent, unbranched or branched hydrocarbon chain having one or more triple bonds therein. The triple bond of an alkynyl group can be unconjugated or conjugated to another unsaturated group. Alkynyl groups include, but are not limited to, e.g., $C_2$-$C_8$ alkynyl groups, such as ethynyl, propynyl, butynyl, pentynyl, hexynyl, and like moieties. Alkynyl groups can be unsubstituted or substituted with one or more substituents (e.g., methylpropynyl, 4-methyl-1-butynyl, 4-propyl-2-pentynyl, and 4-butyl-2-hexynyl). All substituents as will be used by those of skill in the art in view of the invention disclosure are within the scope of the disclosure encompassed hereby. No limitations are intended.

Solvent Fluids

Solvent fluids in which selected metal precursors have solubility are suitable for use in conjunction with the invention including, e.g., compressible gases and/or liquids. Compressible gases include, but are not limited to, e.g., carbon dioxide, ethane, ethylene, propane, butane, sulfurhexafluoride, ammonia, including derivatives and substitution products thereof, e.g., chlorotrifluoroethane, or the like, and combinations thereof. Liquid solvents include, but are not limited to, e.g., benzene, alkanols, and other liquid solvents known to those of skill in the art. Solvent fluids may be comprised of a single solvent or more than one solvent, e.g., a co-solvent fluid. In other embodiments, combinations of compressible gases and liquid solvents can be used, e.g., $CO_2$, benzene, methanol. In another embodiment, a liquid solvent is used to premix the metal precursor for introduction into a bulk compressible solvent fluid, effecting deposition of the metal film. In still yet another embodiment, a metal precursor is premixed in a compressible solvent fluid and introduced when required into the bulk compressible solvent fluid, effecting deposition of the metal film. No limitations are intended. All compressible gases and liquids as will be contemplated or selected for use as solvent fluids by those of skill in the art in view of the disclosure are within the scope of the invention.

Carbon dioxide ($CO_2$) is an exemplary solvent fluid having easily attainable critical parameters (i.e., critical temperature ($T_c$)=31° C. and critical pressure ($P_c$)=72.9 atm, *CRC Handbook,* 71$^{st}$ ed., 1990, pg. 6-49; and critical density ($\rho_c$)~0.47 g/mL, *Properties of Gases and Liquids,* 3$^{rd}$ ed., McGraw-Hill). Pressures of carbon dioxide are selected in the range from about 830 psi (56.48 atm) to about 10,000 psi (680.46 atm). More particularly, pressures are selected in the range from about 1500 psi (102.07 atm) to about 5,000 psi (340.23 atm). Most particularly, pressures are selected in the range from about 2250 psi (153.10 atm) to about 3,000 psi (204.14 atm). No limitations are intended. Temperature, pressure, and density regimes will depend on critical, near-critical, and supercritical fluid (SCF) parameters for the mixed precursor solution prepared by mixing the selected precursor and any associated reagents in the solvent fluid. Many temperatures and pressures for mixed precursor solutions are practicable if the density of the solution is maintained above that needed for solubility of the precursor and associated reagents. Further, density increases may be exploited in a given solution by effecting changes to pressure and/or temperature in the system. Similar or greater effects can be attained in SCF fluids where higher densities may be exploited as a function of pressure and/or temperature.

Reagents

Reagents having solubility in the selected solvent fluid at liquid, near-critical, or supercritical conditions for the solvent may be used in conjunction with the invention. Reagents include, but are not limited to, e.g., reducing agents, catalytic agents (i.e., catalysts), as well as other reagents facilitating desired outcomes. No limitations are intended. Preferred reagents do not react with, or are otherwise compatible with, solvents used for premixing of the metal precursors and/or those employed as the principal solvent. Reducing agents include, e.g., hydrogen ($H_2$), alcohols (e.g., n-alkanols, methanol, ethanol, etc.) and other suitable reducing agents apparent to those skill in the art. Hydrogen is an exemplary reagent given 1) its effectiveness as a reducing agent, 2) its oxygen scavenging capacity, and 3) its solubility in selected gaseous solvent fluids. In one embodiment, hydrogen is added to a solvent fluid comprised of carbon dioxide at selected liquid, near-critical, or supercritical conditions for the solvent fluid.

Methods for introducing reagents and precursors in conjunction with the invention are not limited. For example, reagents may be introduced directly to a deposition chamber as solids, liquids, or gases prior to mixing in the solvent fluid or may be premixed in a solvent and delivered to a deposition chamber at liquid, near-critical, or supercritical temperatures for the selected solvent fluid. In other embodiments, reagent(s) may be delivered to a deposition chamber at lower or higher temperatures than ultimately required to effect deposition and subsequently heated or cooled to desired liquid, near-critical, or supercritical temperatures to effect controlled deposition. In still yet other processes, reagents and/or precursors may be added substantially continuously, intermittently, or batch-wise, e.g., for controlled mixing and/or for concentration control. Thus, no process limitations are hereby intended. All reagents, precursors, and procedures as will be contemplated by those of skill in the art in view of the disclosure are within the scope of the disclosure.

Those of skill in the art will recognize that the invention is not limited by types of reactions or sequence of reactions occurring, e.g., between precursor(s), reagent(s), and/or deposition material(s). Reactions include, but are not limited to, reduction, disproportionation, dissociation, decomposition, displacement, photolysis, and combinations thereof. For example, release of a deposition material (e.g., tantalum metal) from a precursor to a solvent fluid may be effected in a deposition vessel or reaction chamber, e.g., by thermal decomposition, dissociation, or displacement, permitting subsequent reaction with, e.g., a reducing reagent, yielding ultimate deposition to a substrate or surface. In another example, introduction of a gas, solid, or liquid reagent to a deposition vessel or reaction chamber can initiate reaction between a precursor and the reagent, and/or between a deposition material released from the precursor and the reagent. No limitations are intended.

Tantalum Precursors

Tantalum precursors suitable for use in conjunction with the invention are of the following general forms, denoted in [1] and [2]:

$$[(Cp)(Ta)(CO)_{4-N}(L_N)] \quad [1]$$

$$[(In)(Ta)(CO)_{4-N}(L_N)] \quad [2]$$

In [1], (Cp) denotes a cyclopentadienyl ($C_5H_5$) ring. In [2], (In) denotes an indenyl polycyclic hydrocarbon (i.e., $C_9H_7$), as illustrated in [3] and [4], respectively, hereafter:

[3]

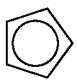

≡ Cp

[4]

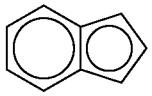

≡ In

Precursors, including those denoted in [1] and [2], have solubility in solvent fluids described herein and stability at selected liquid, near-critical, or supercritical fluid conditions (e.g., temperatures, pressures, densities) of the solvent fluids employed as well as the mixed precursor solutions described herein. Precursors are chemical compounds or moieties comprised of ligands that are sufficiently thermally labile or facile as to be removed at or above the decomposition, melt, or release temperatures for the precursors. Ligands ($L_N$) include, but are not limited to, e.g., carbonyl (CO) and other substituent ligands including, but not limited to, e.g., —(P)$R_1R_2R_3$, —(N)$R_1R_2R_3$, alkenes (e.g., $H_2C{=}CH_2$), alkynes (e.g., HC≡CH), and like moieties. Here, $R_1$, $R_2$, and $R_3$ represent like or different R-groups. R-groups are not limited as long as solubility is maintained in the selected solvent. R-groups include, but are not limited to, e.g., H, alkyl groups (e.g., methyl, ethyl, propyl, etc.), alkenyl groups (e.g., $H_2C{=}CH_2$, propenyl, and etc.), alkynyl groups (e.g., HC≡CH, and etc.), as described herein, and other like moieties. Other suitable ligands (L) may be employed, including e.g., photolabile ligands, photolytically-releasable ligands, photolytically-exchangeable ligands, or photolytically-sensitive ligands, meaning those that are photolytically releasable and/or exchangeable from the parent precursor at various wavelengths. Tantalum (Ta) in these precursors (e.g., complexes) is a constituent metal ion in the (+1) oxidation state. Synthesis and chemistry of these compounds is detailed, e.g., by Bitterwolf et al. [*J. of Organometallic Chem.,* 557 (1998) 77-92]. Bonding chemistries associated with cyclopentadienyl rings and indenyl polycyclic hydrocarbons in tantalum (tantalocene) complexes are keenly influenced by an unpaired electron available in these species, giving rise to both coordination and pi (π)-bonded compounds. Both cyclopentadienyl (Cp) rings and indenyl (In) polycyclic hydrocarbons can further comprise various substituent R-groups, as illustrated in [5] and [6] hereafter:

[5]

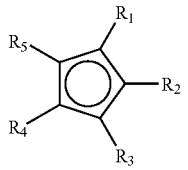

[6]

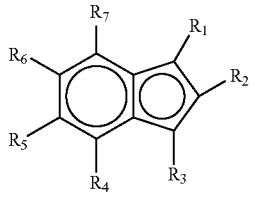

Here, $R_1$ through $R_7$ represent like or different R-groups. R-groups include, e.g., branched-chain, straight-chain, and aromatic substituents. Those of skill in the art will recognize that numerous and various chemical groups are suitable for use as R-group functionalities on the (Cp) rings and (In) polycyclic hydrocarbons. All R-groups as will be known or selected by those of skill in the art may be used as long as solubility of the precursor is maintained in the selected solvent. No limitations are intended. All precursors having a decomposition, melt, or release temperature applicable to the fabrication or manufacturing process of interest and solubility in the selected solvent may be used, permitting selective deposition of metal films to surfaces and/or substrates over a wide range of temperatures and conditions. Table 1 lists two exemplary tantalum precursors tested in conjunction with the invention.

TABLE 1

Thermal Decomposition Temperatures for two Tantalum Precursors.

| Deposition Metal | Precursor* | Decomposition/Release Temperature** (° C.) |
|---|---|---|
| Ta | (In)Ta(CO)$_4$ | 169 |
| Ta | (Cp)Ta(CO)$_4$ | 171–173 |

*Synthesized and obtained from Professor Thomas Bitterwolf at the University of Idaho (Moscow, ID). (In) = Indenyl polycyclic hydrocarbon; (Cp) = Cyclopentadienyl ring; (CO) = carbonyl ligand.
**Data provided by Professor Thomas Bitterwolf, Dept. of Chemistry, University of Idaho (Moscow, ID).

Precursor concentrations up to the limit of saturation in the selected solvents may be used. No limitations are intended.

Deposition Surface Temperature

The terms "decomposition temperature" or "temperature of decomposition" ($T_d$) as used herein mean the temperature at which tantalum is released from the metal precursor or is otherwise made available for deposition whether by displacement, dissociation, melting, decomplexation, or decomposition of the precursor. Surface temperatures at or above the decomposition temperature of the precursor may be employed for effecting deposition of metal films. In particular, surface temperatures are selected in the range from the decomposition temperature ($T_d$) of the selected precursor to about 600° C. More particularly, deposition surface temperatures are selected in the range from the decomposition temperature ($T_d$) to about 400° C. Most particularly, deposition surface temperatures are selected in the range from the decomposition temperature ($T_d$) to about 350° C.

As will be understood by those of skill in the art, temperature of a deposition surface may be effected in various and alternate ways including, but not limited to, e.g., direct heating or cooling of a surface(s) and/or substrate; heating or cooling of a stage or platform in contact with a surface(s) and/or substrate; heating or cooling of a fluid in contact with a surface(s) and/or substrate; heating or cooling of a solution (i.e., precursor solution) containing a precursor in contact with a surface(s) and/or substrate; or combinations thereof. No limitations are intended. For example, temperatures of a stage or platform in contact with a deposition surface(s) and/or substrate may be selected (e.g., via cooling and/or heating) in the range from about 100° C. to about 1500° C. More particularly, temperatures may be selected in the range from about 25° C. to about 600° C.

Further, temperature and pressure conditions for the deposition chamber will further depend on the solvent and reagent choices employed as will be understood by the person of skill in the art. No limitations are intended. For example, pressures may further be manipulated within a deposition chamber or vessel for effecting conditions suitable for solvents and/or solutions employed therein. In particular, pressures are selected in the range from about 1 psi (0.068 atm) to about 20,000 psi (1361 atm). More particularly, pressures are selected in the range from about 500 psi (34 atm) to about 5000 psi (340 atm). Most particularly, pressures are selected in the range from about 2000 psi (136 atm) to about 3000 psi (204 atm). No limitations are intended.

All mechanisms and methods contemplated by those of skill in the art for controlling temperatures of a deposition surface to effect deposition at a deposition surface are within the scope of the invention encompassed hereby.

Multilayer Composites and Structures

The invention is not limited to deposition of single films or layers. For example, deposition of tantalum films may be further combined with other solution processes disclosed in pending U.S. patent application Ser. No. (11/096,346), as well as processes known in the art (e.g., CVD, PVD) to generate multilayer films and composites, e.g., binary, tertiary, and higher-order composites and structures comprised of materials including, but not limited to, e.g., metals, ceramics, and polymers, or the like, and combinations thereof. For example, in various embodiments, tantalum films are deposited on substrates and surfaces selected from the group of ceramics (e.g., TaN, SiC), metals (e.g., Cu, Ru), polymers (e.g., OSG, siloxanes), and combinations thereof, but is not limited thereto. In one embodiment described further herein, a tantalum film is deposited on a substrate comprised of OSG; copper metal subsequently deposited generates a tertiary composite comprised of OSG/$Ta^o$/$Cu^o$. In another embodiment, a binary composite comprised of tantalum film deposited on an underlying substrate of OSG with a diffusion layer cover comprised of a SiC ceramic generates a tertiary OSG/SiC/$Ta^o$ composite. In yet another embodiment, a binary composite structure is fabricated by deposition of a tantalum film to an OSG substrate, i.e., OSG/$Ta^o$. Ta is a getter for oxygen present in the OSG. As a consequence, XPS analysis shows the composite is a structure comprised of OSG/$Ta_2O_5$/$Ta^o$/$Ta_2O_5$. Other multilayer composites and structures are likewise achievable, as detailed herein, e.g., OSG/$Ru^o$/$Ta^o$/$Cu^o$; OSG/$Ru^o$/$Ta^o$; $_{OSG/Ru}{}^o$/$Ta^o$/$Cu^o$; OSG/$Ru^o$/$Ta^o$/$Ru^o$; OSG/Ru/$Ta^o$/$Cu^o$. In general, various multilayer composites and feature pattern composites have been fabricated in conjunction with deposition of tantalum films of the invention to various substrates and surfaces. Results further demonstrate that order of deposition of tantalum metal films in a layered, and/or metal, composite is not limited, whether deposition constitutes a first layer or a final layer in a composite or structure. Thus, no limitations are intended.

Processing of multilayer composites may further entail chemical or physical preparation of substrates and/or surfaces enabling adhesion of the metal films produced, as well as post-deposition processing steps including, but not limited to, e.g., additional chemical reactions and/or depositions in pressurized systems, thermal annealing, evacuation processing (CVD, PVD, ALD), and/or removal of unwanted reaction products to ensure desired film characteristics. For example, equipment, systems, and processes disclosed in pending U.S. patent applications Ser. Nos. (10/783,249, 11/149,712, 11/210,546) may likewise be combined providing for mixing of process fluids, and processing of substrates). Other like and/or associated processes and systems may likewise be coupled as will be understood and implemented by those of skill in the art in view of the disclosure. No limitations are intended.

System for Selective Deposition of Tantalum

FIG. 1 illustrates a system 10 of a simple bench-scale design, according to an embodiment of the invention, for deposition of tantalum metal films. System 10 comprises a deposition vessel or reaction chamber 12 of a high pressure design for containing solvent fluids, reagents, mixed precursor solutions, and the like introduced thereto. Vessel 12 is adapted for housing and heating of substrates introduced thereto having surfaces whereon deposition of metal films is to be effected. Vessel 12 couples optionally to a solvent fluid source 14, e.g., ultra-high-purity $CO_2$, and an optional reagent source 16, e.g., hydrogen (99.5%). Solvents and reagent fluids (e.g., $CO_2$ and $H_2$) may be pre-treated to remove impurities, oxidizing species, and/or oxygen, e.g., in conjunction with specific filters or cartridges (e.g., Oxy-Trap cartridges, Alltech Associates, Inc., Deerfield, Ill., USA). Pressure is programmed and maintained in system 10 and vessel 12 using, e.g., a feed pump 18 (e.g., a model 260-D microprocessor-controlled syringe pump, ISCO Inc., Lincoln, Nebr.) in fluid connection with solvent fluid source 14. In the instant system, components are operatively linked via 0.020-0.030 inch I.D. and $1/16^{th}$-inch O.D. high-pressure liquid chromatography (HPLC) transfer line(s) 20 composed of a high-strength polymer (e.g., PEEK™, Upchurch Scientific Inc., Whidbey Island, Wash.) or stainless steel tubing, but is not limited thereto. Solvent fluid is introduced to vessel 12 via standard valve 22 (e.g., a model 15-11AF1 two-way straight valve or a model 15-15AF1 three-way/two-stem connection valve, High Pressure Equipment Co., Erie, Pa., or other appropriate valve) from transfer line 20 leading from pump 18 to vessel 12. Reagents are introduced to vessel 12 from reagent source 16 through another standard valve 22 (e.g., a model 15-11AF1 two-way straight valve, High Pressure Equipment Co., Erie, Pa.). Solvents, reagents, precursors, and/or fluids may be mixed optionally in a premixing cell 36 prior to introduction to vessel 12. A standard pressure gauge 24 (e.g., a Bourdon tube-type Heise gauge, Dresser, Inc., Addison, Tex.) is connected to vessel 12 for measuring pressure in system 10, but is not limited thereto. Vessel 12 is suitably vented to a standard fume hood through yet another standard valve 22 or like vent valve. Vessel 12 is further coupled to a rupture disk assembly 28 (e.g., a model 15-61AF1 safety head, High Pressure Equipment Co., Erie, Pa.) preventing over-pressurization of vessel 12. Vessel 12 is coupled electrically to current source 30 for heating substrates and fluids introduced to vessel 12. Vessel 12 is further linked to cooling source 32 (e.g., a circulation bath) for cooling and/or maintaining suitable temperatures in vessel 12. Temperature of vessel 12 is displayed by standard thermocouple temperature display(s) 34 or like device. The person of skill in the art will recognize that equipment and components can be appropriately configured and scaled to address specific commercial applications, industrial requirements, processes, and/or manufacturing purposes without deviating from the spirit and scope of the invention. For example, fabrication and/or processing of commercial (e.g., 300 mm diameter) semiconductor wafers and electronic substrates may incorporate various transfer systems and devices, reagent delivery systems, spraying equipment and/or devices, pressurization chambers, evacuation chambers, and/or other allied processing systems, devices, and/or equipment components, e.g., computer systems for process integration and control. Description of the instant bench-scale system is not intended to be limiting. All equipment, components, and devices as will be contemplated for use by those of skill in the art in view of the disclosure are within the scope of the disclosure. Vessel 12 will now be further described with reference to FIG. 2.

Figure 2:
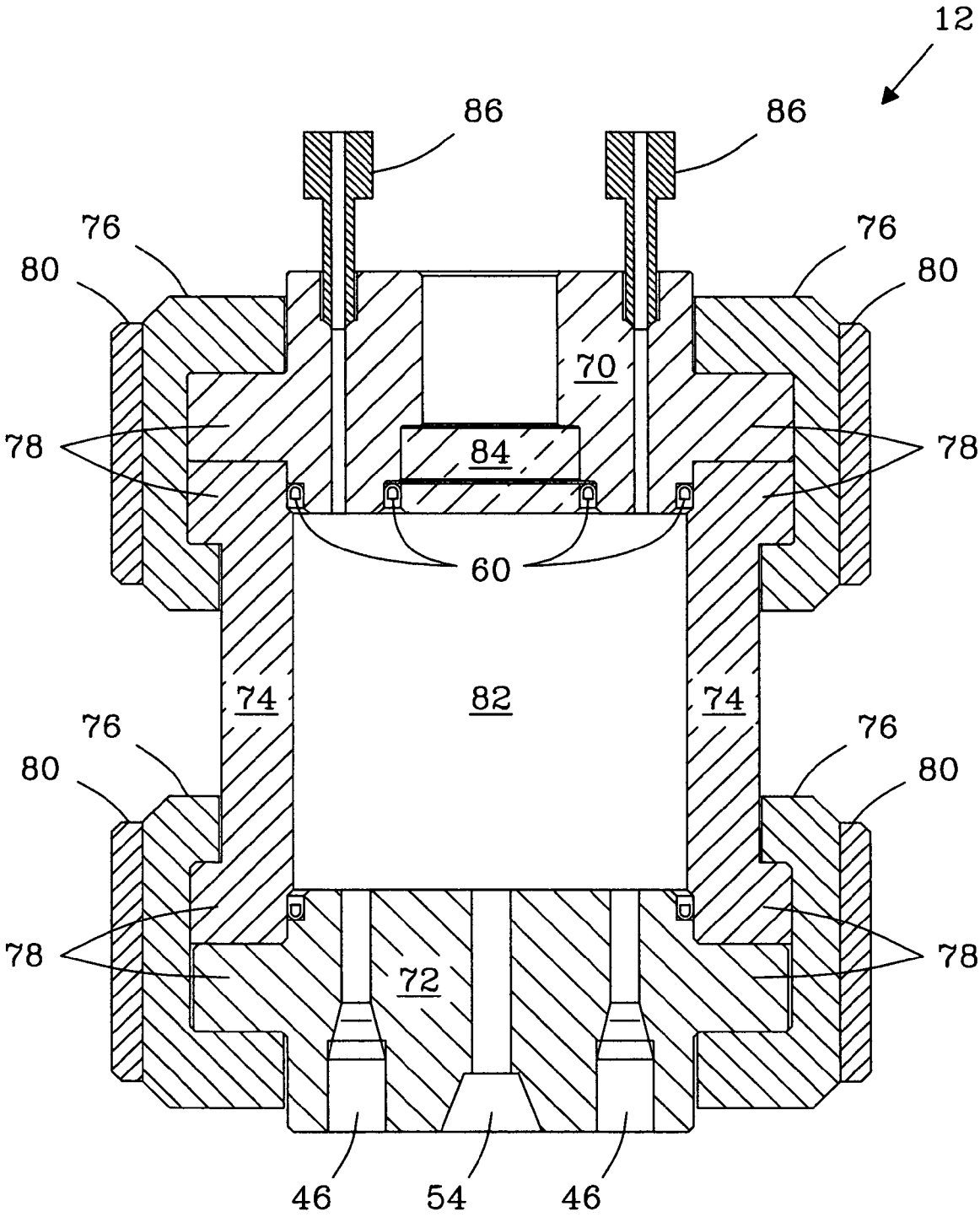
FIG. 2 presents a cross-sectional view of a high pressure vessel for depositing tantalum metal films to a selected surface(s), sub-surface(s), and/or pattern feature surface(s) of a substrate.

FIG. 2 illustrates a vertical cross-sectional view of deposition vessel (or reaction chamber) 12, according to an embodiment of the invention. Vessel 12 comprises a top vessel section 70, a bottom vessel section 72, and a center vessel section 74 machined of a refractory metal, e.g., titanium. Sections 70, 72, and 74 when assembled define a deposition chamber 82 sealed using high pressure locking clamp(s) 76 (e.g., a split-ring cover clamp, Parr Instrument Co., Moline, Ill., USA) that mounts over securing rim portions 78 machined into each of top 70, bottom 72, and center 74 vessel sections, respectively, effecting a pressure and temperature seal in vessel 12. Clamp(s) 76 is secured via locking ring 80 positioned about the perimeter of clamp(s) 76. A window 84 (comprised, e.g., of a sapphire crystal, Crystal Systems Inc., Salem, Mass. 01970) is optionally positioned in top vessel section 70 for observing phase and mixing behavior of fluids and reagents introduced to chamber 82, and introducing light from photolytic sources as described herein. Chamber 82 is optionally viewed through window 84 in conjunction with a high performance camera (e.g., a Panasonic model GP-KR222 Color CCD camera, Rock House Products Group, Middletown, N.Y.) (not shown) coupled to a standard terminal display (not shown), or other viewing system. No limitations are intended. In the instant embodiment, vessel 12 is configured with ports 86 for introducing or removing fluids from chamber 82, but is not limited thereto. Seals 60 effect a pressure and temperature seal in vessel 12 prior to or following introduction of fluid constituents. Feedthroughs 46 and 54 in bottom vessel section 72 provide entry points for coupling of devices and/or systems external to vessel 12.

Deposition chamber 82 will now be further described with reference to FIG. 3.

Figure 3:
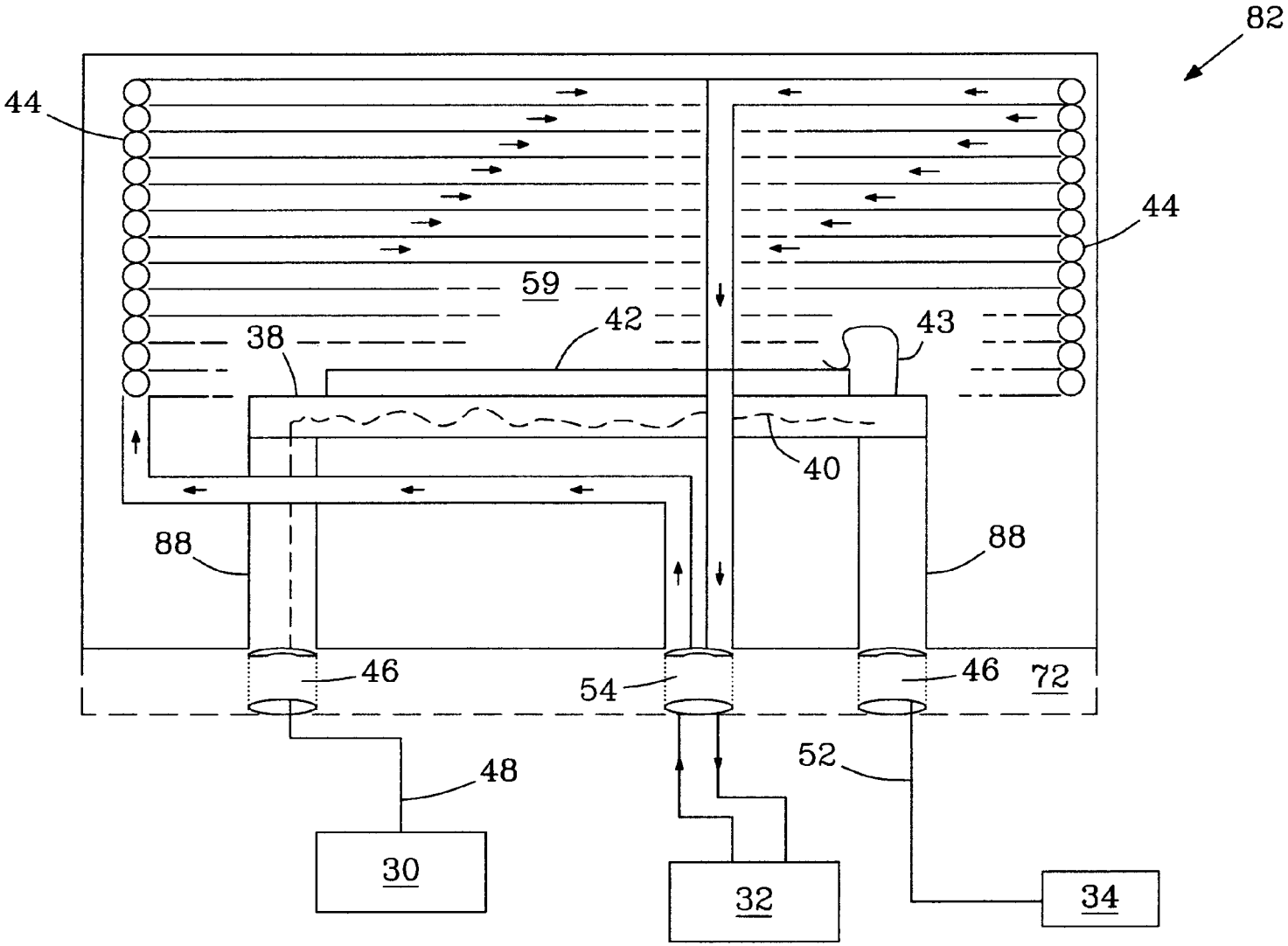
FIG. 3 presents a cross-sectional view of a deposition chamber of a high pressure vessel for depositing tantalum metal films, according to an embodiment of the invention.

FIG. 3 presents a cross-sectional view of deposition chamber 82 internal to vessel 12 for selectively depositing materials to surface(s), e.g., pattern feature surfaces, sub-surfaces, two-dimensional surfaces, three-dimensional surfaces, and/or other complex surfaces (e.g., voids, tunnels) of a substrate (e.g., a semiconductor substrate), according to another embodiment of the invention. Chamber 82 includes a heating stage 38 (e.g., a 25 mm graphite-base Boralectric™ heater, GE Advanced Ceramics, Strongsville, Ohio) mounted to ceramic staging posts (stand-offs) 88 (GE Advanced Ceramics, Strongsville, Ohio). In the instant configuration, stage 38 includes a heating source 40, e.g., a graphite heater core with a resistive heater element for heating substrate 42 positioned on stage 38, including surfaces thereof, but is not limited thereto. All heating sources as will be known by those of skill in the art may be adapted for use herewith and are thus fall within the scope of the disclosure. Substrate 42 is optionally held in place on stage 38 by, e.g., a holding clip 43 or other holding means, but is not limited.

Temperature control (e.g., cooling and/or heating) of chamber 82 is achieved using a plurality of operational modes and devices as will be understood by those of skill in the art. Devices for temperature control include, but are not limited to, e.g., chillers, refrigeration units, temperature controllers, heat exchangers, and like devices and systems. No limitations are intended. In one non-limiting embodiment, chamber 82 of vessel 12 is configured with heat exchanger (cooling) coils 44 that couple to cooling source 32 via feedthrough 54 in bottom vessel section 72, providing temperature control to fluid(s) and substrates introduced to chamber 82 of vessel 12. Heat exchanger coils are made, e.g., of ⅛ inch O.D. stainless-steel tubing. Vessel 12 may be operated in cold-wall deposition mode in conjunction with heat exchanger coils 44, or alternatively in hot-wall deposition mode without heat exchanger coils operating or without a heat exchanger. Current source 30 for heating stage 38 (e.g., a 0-400 VAC variable (variac) transformer, ISE, Inc., Cleveland, Ohio) links to stage 38 via wiring 48 electrically connected through feedthrough 46 in bottom vessel section 72, but is not limited thereto. Thermocouples (not shown), e.g., Type-K thermocouples (Omega, Engineering, Stamford, Conn.) are positioned to measure temperatures in vessel 12, e.g., of heating stage 38, of substrate 42, and/or of solvent fluid 59 (and reagents soluble therein), linking electrically to temperature display devices 34 external to vessel 12 via thermocouple wiring 52 electrically connected through feedthroughs 46, but is not restricted thereto.

Additional components, devices, and instruments may be employed and/or coupled without reservation, e.g., for data collection/measurement, process control, or other requirements. In addition, equipment including, but not limited to, e.g., cooling and/or heating systems, deposition vessels, reaction chambers, vacuum chambers, fluid and/or reagent mixing systems and vessels, transfer systems and devices, computer interfaces, and robotic systems/equipment as will be implemented by the person of skill in the art may be used without limitation. In particular, those of skill in the art will appreciate that combining, intermixing, and/or applying various fluids, precursors, and/or reagents as described herein may be practiced in various and alternate ways. For example, application of the methods described herein on a commercial scale may comprise use of high-pressure pumps and pumping systems, various and/or multiple chambers, e.g., evacuation and/or pressurization chambers, and/or systems for rinsing and/or deposition, transferring, moving, transporting, combining, mixing, delivering and/or applying various fluid(s), solvent(s), reagent(s), and/or precursor(s). Associated application and/or processing steps for utilizing the methods of the present invention or for post-processing collection of waste materials and chemical constituents as would be performed or implemented by those of skill in the art are within the scope of the invention and encompassed hereby. No limitations are intended.

Deposition of tantalum metal films to surfaces and substrates will now be further described.

Deposition of Tantalum (Ta) Metal Films

In one embodiment, a low valence state tantalum (Ta) metal precursor, $(In)Ta(CO)_4$, is mixed into a selected solvent fluid (e.g., $CO_2$) forming a precursor solution. The deposition surface of the substrate is subsequently exposed to the precursor solution at liquid, near-critical (sub-critical), or super-critical conditions for the solution, at a temperature equal to or exceeding the decomposition, melt, or dissociation temperature for the precursor. Tantalum (Ta) metal ions released from the precursor are subsequently deposited to the deposition surface as a tantalum (i.e., $Ta^0$) metal film. A reducing reagent (e.g., hydrogen) is introduced, e.g., as described by Watkins (U.S. Pat. No. 6,689,700 B1) to induce the reduction of tantalum metal released from the precursor to the deposition surface and/or to the substrate. Hydrogen gas also serves to prevent undesired oxidation reactions. In the instant embodiment, hydrogen is present at a stoichiometric excess in the mixed solution, but is not limited thereto. In another embodiment, $(Cp)Ta(CO)_4$, another low valence state (Ta) metal precursor is employed. Using the low valence oxidation state (Ta) metal precursors, e.g., $InTa(CO)_4$ or $CpTa(CO)_4$, pure (Ta) metal films can be deposited on a substrate or deposition surface, e.g., on blanket organosilica glass (OSG) substrates typical of semiconductor wafers and chips, or surfaces and layers comprised of the same, or other surfaces and layers including, e.g., metal surfaces and layers. Once the Ta (0) metal layer is deposited, other process steps known in the art may be coupled without limitation including, e.g., annealing in an ammonia ($NH_3$) solution at suitable pressure to form TaN (useful as a diffusion barrier). In other embodiments, the Ta(0) film layer can used as a seed layer or be used to form binary or higher order (e.g., ternary, quaternary, and the like) layered films comprised of, e.g., metals such as Ru(0) or Cu(0), as described further herein. No limitations are intended. For example, all materials fabrication and/or processing steps as will be contemplated by those of skill in the art in view of the present disclosure are within the scope of the invention.

Decomposition of metal precursors effecting deposition of tantalum metal films to a deposition surface and/or substrate will now be described.

[1] Thermal Release for Deposition of Tantalum Films

In one embodiment, release of tantalum metal ions from tantalum precursors described herein is effected thermally in conjunction with a heat source(s). Heat source(s) include, but are not limited to, e.g., infra-red source(s), convective source(s), resistance (resistive) source(s), ultrasonic source(s), mechanical source(s), chemical source(s), fluid source(s), and the like, and combinations thereof. Heat sources provide heat necessary for decomposition, melting, or dissociation of the tantalum metal precursors thereby achieving release of tantalum metal ions to solution. Heat source(s) further provide temperatures suitable for deposition of metal films at a deposition surface(s) or substrate situated in thermal communication with the heat source(s). In one illustrative embodiment, a ceramic heating stage, described further hereinbelow, having a resistive heating element (e.g., wire) is employed as a heat source. The heating stage is mounted, e.g., within a pressurized vessel, operable for mounting substrates (e.g., semiconductor substrates) thereto and for heating of the same. In alternate embodiments, the heat source can be positioned below a substrate or adjacent to a substrate or above a substrate thereby generating suitable temperature profiles at a deposition surface, e.g., at the surface of a substrate, or suitable temperature gradients vertically through a substrate, or at selected depths of a multilayered or composite substrate permitting deposition at surfaces therein, e.g., as detailed in pending U.S. application Ser. No. 11/096,346 incorporated herein in its entirety.

As will be recognized by those of skill in the art, the invention is not limited to chemistries resulting from temperature only (e.g., precursors that release deposition materials in response to temperatures). In particular, both deposition and release chemistries are also controlled and/or influenced by such factors as pressure, catalysis, concentration, rates (e.g., of decomposition and reaction), and other associated parameters including, e.g., kinetics, diffusion, thermodynamics, and the like, or combinations thereof. In addition, control of concentration as a deposition parameter has implications for selective deposition of various materials during, e.g., repair of semiconductor chip substrates and/or fabrication of devices constructed thereon. For example, manufacture of tiny devices including, e.g., advanced micro-electro-mechanical systems (mems) structures, small cantilevers, fans, and other similar mechanical devices on a substrate can involve selectively removing substrate material(s) (e.g., 3-dimensionally) and selectively depositing other material(s) (e.g., refilling) in accordance with processes of the present invention. All processes, modalities, and/or parameters generating conditions suitable for selective deposition of materials to substrates and/or surfaces as will be contemplated or instituted by those of skill in the art in view of the present disclosure are within the scope of the present invention. No limitations are hereby intended.

[2] Photolytic Release for Deposition of Tantalum Films

In another embodiment, decomposition of the metal precursor may be effected, or further controlled, photolytically in conjunction with photolytic sources at suitable wavelengths for the intended photolytic application, as will be understood by those of skill in the art. Photolytic sources include, but are not limited to, e.g., visible (VIS) source(s), ultra-violet (UV) source(s), ultra-violet/visible (UV/VIS) source(s), laser source(s), and combinations thereof. No limitations are intended. At suitable wavelengths, ligands of a precursor can be selectively and photolytically removed, e.g., as detailed by Bitterwolf et al. (in *J. of Organometallic Chem.,* 557 (1998) 77-92). For example, photolysis of precursors detailed herein, i.e., $[(Cp)Ta(CO)_4]$ and/or $[(In)Ta(CO)_4]$ can result in removal or exchange of from one to three (CO) ligands selectively. Wavelengths selected will depend in part on the selected ligand(s), absorption maxima from the selected light source (e.g., VIS, UV-VIS, etc.) for compounds or precursors employed, and the frequency range of interest, as will be understood by those of skill in the photolytic art. In general, wavelengths are selected that maximize the absorbance of the ligand of choice in the frequency range of interest providing sufficient energy to the ligand to excite it, energetically remove it from the precursor or metal complex, e.g., via photolytic and/or combined thermal/photolytic decomposition. Alternatively, a light source can be used to effect decomposition of the precursor, effecting release of the metal from the precursor. Thus, controlled release of a constituent metal can be achieved, providing for controlled deposition on the selected substrate and/or surface. In one illustrative configuration, the photolytic source is an arc lamp positioned orthogonally to the deposition chamber window through which light from the light source is directed into solution effecting decomposition of the metal precursor and subsequent release and deposition of tantalum metal to the surface or substrate. All wavelengths and light sources as will be selected by those of skill in the art in view of the disclosure are within the scope of the invention.

[3] Combined Photolytic and Thermal Release for Deposition of Tantalum Films

In another embodiment, photolysis may be used synergistically with thermal release of the precursor metal (i.e., via thermal decomposition of the metal precursor) described previously herein. At suitable wavelengths, for example, photolysis of one or more or specific ligands from the metal precursor may reduce thermal decomposition temperatures needed for release of metal ions, for example, thereby reducing process requirements for deposition of a metal film to a surface or substrate as compared to thermal decomposition alone.

[4] Thermal Release and Photolytic Substitution via Photolytic Agent for Deposition of Tantalum Films In yet another embodiment, facile ligands (L) of a metal precursor can be removed thermally and/or photolytically at suitable wavelengths, and photolytically exchanged or substituted at suitable wavelengths subsequently with secondary ligand(s) or other substituent(s), e.g., with ethylene functional groups, whether pre-, in-, or post-process. Ligands (L)

suitable for exchange are not limited. Ligands may be selected from any photolytically-releasable, photolytically-exchangeable, or photolytically-sensitive class of ligands. Selection will depend at least in part on deposition conditions sought for the process or application undertaken. For example, precursor ligands exchanged photolytically can provide different release temperatures for the tantalum-bearing precursor, providing a mechanism for control of both release and subsequent deposition of the metal film to a selected surface(s) and/or substrate. Photolysis may similarly effect other conditions and/or processing parameters. Various and different methodologies as will be contemplated and/or practiced by those of skill in the art (see, e.g., Linehan, et al., *J. Am. Chem. Soc.* 1998, 120, 5826-5827) in view of the disclosure are encompassed hereby. No limitations are intended.

Photolytic processing of ligands can thus be expected to affect metal film formation in at least two ways: (1) predispose metal precursors to undergo thermal decomposition leading to metal film deposition, or (2) provide for photolytic removal of one or more ligands and exchange or substitution with one or more secondary ligands or substituents, providing, e.g., different thermal and/or processing requirements (e.g., lower temperatures) for metal film deposition.

The invention will now be further demonstrated by reference to the following examples.

EXAMPLES

The following examples are intended to promote a further understanding of deposition of tantalum metal films to various surfaces and substrates, in accordance with the invention. Example 1 details general conditions for deposition of tantalum metal films to a surface(s) and/or substrate. Examples 2-4 detail experiments demonstrating deposition of tantalum metal films to various substrates yielding binary, tertiary, and higher-order layered composites. Example 5 describes experiments demonstrating deposition of tantalum metal films on substrates having complex feature patterns, e.g., trenches. Example 6 details preparation of a multilayered composite in accordance with the invention comprising a ceramic coated substrate and a bi-layer metal film.

Example 1

Deposition of Tantalum Metal Films (General)

Example 1 details general conditions for deposition of tantalum metal films to surfaces and substrates. In a typical test, a OSG substrate comprising of a silicon (Si) wafer coupon (as base) and a surface layer (e.g., a ~200 nm) of organosilane glass (OSG) is secured to a ceramic heating stage in a high pressure vessel described previously herein, but is not limited thereto. The deposition chamber of the instant high pressure test vessel holds ~80-90 mL fluid volume, but chamber volumes are not limited. Precursor concentrations in solution are also not limited, and may be dilute or concentrated to the point of saturation in the selected solvent.

In typical operation, the high pressure vessel was pressurized with 100 psi (6.80 atm) hydrogen and to a total pressure of 1100 psi (74.85 atm) with carbon dioxide ($CO_2$) and operated in either cold-wall deposition mode or hot-wall deposition mode, as described herein. ~25 mg to ~80 mg of solid tantalum metal precursor was premixed in ~30 mL $CO_2$ solvent fluid and stored separately as a mixed precursor solution. Typical concentrations of the mixed metal precursor in the selected solvent ranged from about 2.3 mM to about 7.5 mM, but are not limited. The mixed precursor solution was injected into the solvent-charged deposition chamber (cell) containing the substrate and heated in conjunction with a heating stage. Stage temperatures were in the range from about 300° C. to about 380° C., achieving a solution temperature of about 120° C. and effecting release of tantalum and deposition of a tantalum metal film to the surface or substrate. Surface or substrate contact time with the precursor solution in the chamber was about 5 minutes, but is not limited. Conditions are presented in Table 2.

TABLE 2

Precursors and solution conditions for deposition of tantalum metal films on substrates.

| Precursor | Substrate* | Solvent Fluid | Stage (° C.) | Precursor Solution (° C.) | $H_2$ (psi) |
|---|---|---|---|---|---|
| $(In)Ta(CO)_4$ | OSG | $CO_2$ | ~350 | ~120 | 100 |

*organosilane glass (OSG).

Factors governing thickness of the tantalum metal films deposited to surfaces and substrates include, but are not limited to, e.g., surface and/or substrate temperatures, precursor concentration in solution, and contact time with the mixed precursor. Post-processing examination of test coupons was conducted using Scanning Electron Microscopy (SEM) and Transmission Electron Microscopy (TEM). Purity of deposition materials was evaluated using X-ray Photoelectron Spectroscopy (XPS). XPS data of the tantalum (Ta) films deposited on the surface of the OSG coupons showed the film is partially comprised of $Ta_2O_5$, a consequence of exposure to the oxygen-rich OSG surface at the interface, oxidization of the Ta film during sample storage, and/or the presence of oxidizing species in the deposition solvent, which may be eliminated with more stringent handling of the substrate films or with improved purity of the solvent.

Example 2

Deposition of Tantalum Films of the Invention Yielding Binary, Ternary, and Higher-order Layered Composites [1]

Example 2 details deposition of tantalum metal films to various substrates yielding binary, ternary, and higher-order layered composites.

In a first experiment, a bi-layer metal film and ternary composite was prepared as follows. A tantalum metal film was deposited in accordance with the invention to an organosilane glass (OSG) substrate using a tantalum metal precursor [$(In)Ta(CO)_4$] introduced to a carbon dioxide solvent fluid. Conditions are listed in Table 3.

TABLE 3

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent$^{\Delta\Delta}$ |
|---|---|---|---|---|---|---|
| $(In)Ta(CO)_4$ | OSG | $CO_2$ | ~350 | ~120 | 100 | — |
| $Ru_3(CO)_{12}$ | OSG/ CFD-$Ta^0$ | $CO_2$ | ~350 | ~120 | 10 | 1 mL Acetone |

*organosilane glass (OSG). Constituents listed L to R beginning from innermost layers or surfaces to outermost layers or surfaces on the substrate.
$^{\Delta\Delta}$Acetone not required if solvent fluid sufficiently scrubbed of oxidizing (e.g., $O_2$) species.

Deposition of the tantalum metal film to the OSG substrate was followed by deposition to the resulting substrate (i.e., OSG/CFD-$Ta^0$) of a ruthenium layer, deposited using a "ruthenium deposition" (CFD-$Ru^0$) process and precursor detailed in pending U.S. patent application Ser. No. 11/096,346, incorporated herein, yielding a bi-layer metal film (CFD-$Ta^0$/CFD-$Ru^0$) and tertiary (OSG/CFD-$Ta^0$/CFD-$Ru^0$) composite. XPS analysis confirmed the presence of distinct film layers of both tantalum (Ta) and ruthenium (Ru) metal on the surface of the OSG substrate.

In another experiment, a different bi-layer metal film and tertiary composite was prepared as follows. A ruthenium film layer was first deposited via CFD, as detailed in Example 2 above, to an OSG substrate. A tantalum metal film was then deposited in accordance with the invention to the resulting composite (i.e., OSG/$Ru^0$) using a mixed precursor solution [(In)Ta$(CO)_4$] introduced to a carbon dioxide solvent fluid, yielding a bi-layer metal film (CFD-$Ru^0$/CFD-$Ta^0$) and tertiary (OSG/CFD-$Ru^0$/CFD-$Ta^0$) composite. Finally, an additional CFD ruthenium layer was deposited, yielding a tri-layer metal film and multilayer (OSG/CFD-$Ru^0$/CFD-$Ta^0$/CFD-$Ru^0$) composite, as evidenced by XPS analysis. Conditions are listed in Table 4. Higher order composites may be prepared similarly.

TABLE 4

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent$^{\Delta\Delta}$ |
|---|---|---|---|---|---|---|
| $Ru_3(CO)_{12}$ | OSG | $CO_2$ | ~350 | ~115 | 10 | 1 mL Acetone |
| (In)Ta$(CO)_4$ | OSG/CFD-$Ru^0$ | $CO_2$ | ~350 | ~110 | 100 | — |
| $Ru_3(CO)_{12}$ | OSG/CFD-$Ru^0$/CFD-$Ta^0$ | $CO_2$ | ~350 | ~100 | 10 | 1 mL Acetone |

*organosilane glass (OSG). Constituents listed L to R beginning from innermost layers or surfaces to outermost layers or surfaces on the substrate.
$^{\Delta\Delta}$Acetone not required if solvent fluid sufficiently scrubbed of oxidizing (e.g., $O_2$) species.

In another experiment, a metal bi-layer film and tertiary composite was prepared as follows. First, a ruthenium film was applied to an OSG substrate as detailed in Example 2, yielding an OSG/CFD-$Ru^0$ composite. A ruthenium mirror observed on the surface indicated successful deposition of ruthenium. A tantalum metal film was then deposited in accordance with the invention on the resulting OSG/CFD-$Ru^0$ composite using a precursor solution prepared by mixing a tantalum metal precursor [(In)Ta$(CO)_4$] in carbon dioxide solvent fluid as detailed herein, yielding the desired bi-layer metal film (CFD-$Ru^0$/CFD-$Ta^0$) and tertiary OSG/CFD-$Ru^0$/CFD-$Ta^0$ composite. Conditions are listed in Table 5.

TABLE 5

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent$^{\Delta\Delta}$ |
|---|---|---|---|---|---|---|
| $Ru_3(CO)_{12}$ | OSG | $CO_2$ | ~325 | ~108 | 10 | 1 mL Acetone |
| (In)Ta$(CO)_4$ | OSG/CFD-$Ru^0$ | $CO_2$ | ~350 | ~130 | 50 | — |

*organosilane glass (OSG). Constituents listed L to R beginning from innermost layers or surfaces to outermost layers or surfaces on the substrate.
$^{\Delta\Delta}$Acetone not required if solvent fluid sufficiently scrubbed of oxidizing (e.g., $O_2$) species.

Figure 4:
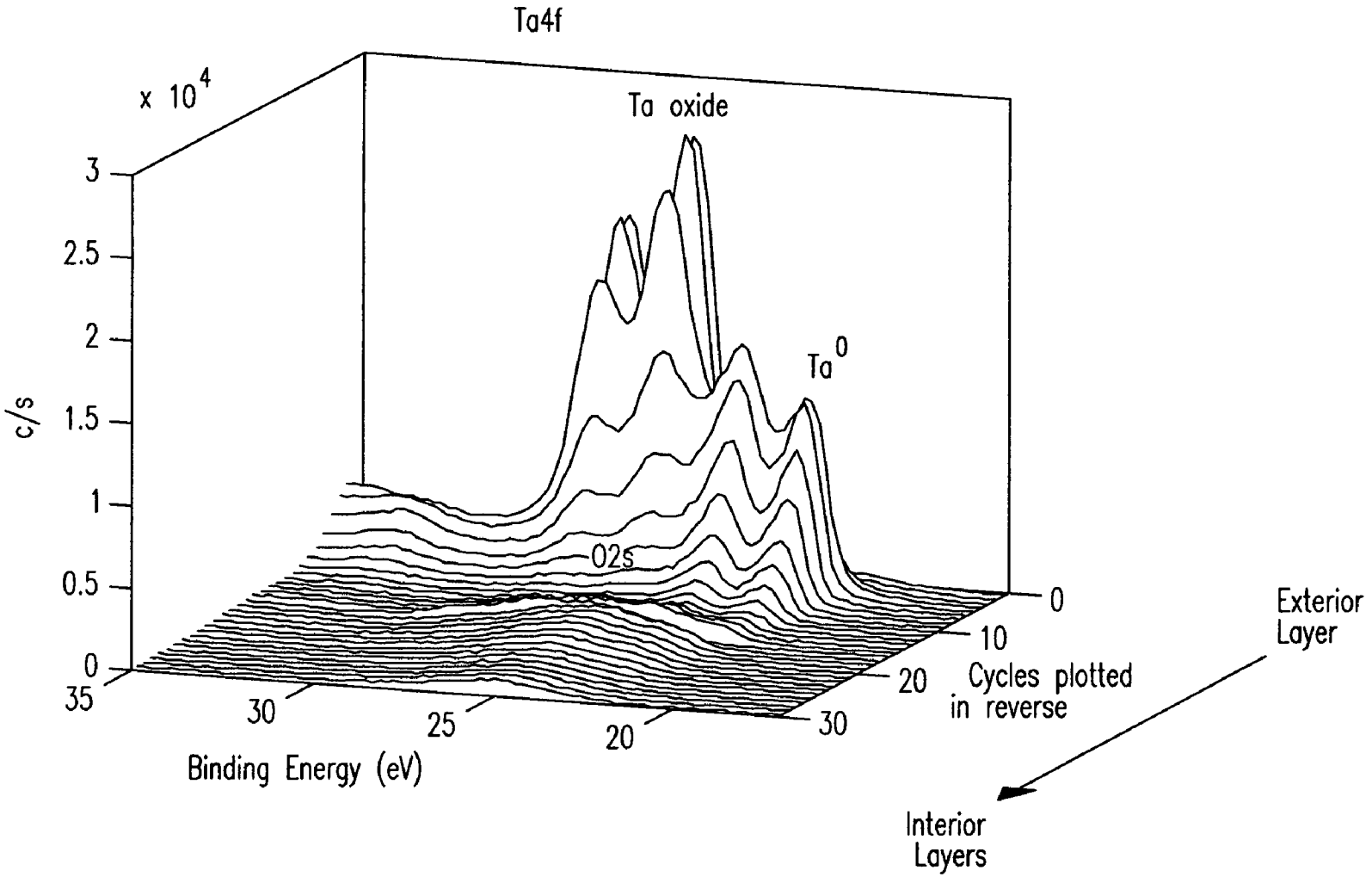
FIG. 4 shows high resolution Ta 4f XPS peak data of a bi-layer metal film comprising a tantalum layer deposited in accordance with the invention atop a ruthenium layer to an OSG substrate, according to another embodiment of the invention. Oxidation state of the tantalum film layer as a function of depth on the substrate is illustrated.
Figure 5:
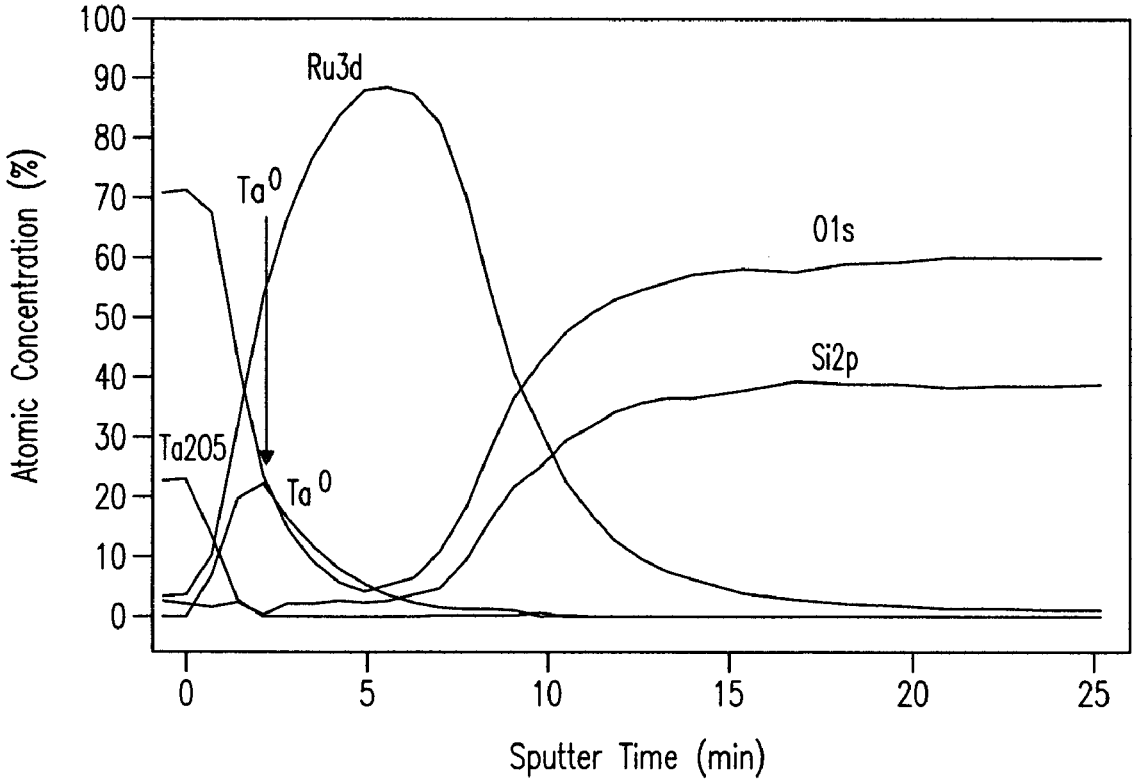
FIG. 5 is an elemental depth profile plot from XPS analysis of a bi-layer metal film comprising a tantalum layer deposited in accordance with the invention atop a ruthenium layer to an OSG substrate, according to another embodiment of the invention. Atomic composition of the film layers as a function of depth on the surface of the substrate is illustrated.

FIG. 4 is a plot (count rate vs. binding energy vs. sputtering cycle) from XPS analysis of the bi-layer metal film (CFD-$Ru^0$/CFD-$Ta^0$) comprising a tantalum layer deposited in accordance with the invention atop a ruthenium layer to an OSG substrate (i.e., OSG/CFD-$Ru^0$/CFD-$Ta^0$), according to another embodiment of the invention. The XPS scan reviewed the spectrum specific to Ta, thus showing the peaks characteristic of reduced Ta and oxidized Ta. Thus, oxidation state of the tantalum film layer as a function of depth on the substrate is illustrated. Results show Ta metal (reduced) is present in the film, indicating successful deposition to the substrate surface. FIG. 5 is an elemental depth profile plot (atomic concentration vs. sputter time) from XPS analysis of the bi-layer metal film (CFD-$Ru^0$/CFD-$Ta^0$) comprising a tantalum layer deposited in accordance with the invention atop the ruthenium layer to the OSG substrate. Atomic composition of the film layers as a function of depth on the surface of the substrate is illustrated. Here, the peak maximum for the Ta metal film profile preceeds the peak maximum for the ruthenium (Ru) profile as a consequence of the sequence of deposition steps performed.

Results show various metal films can be selectively applied to a surface or substrate to form desired multilayer composites. Tantalum oxide ($Ta_2O_5$) is also observed in the data sets. Some crazing, or fine cracks, were also observed in the Ta films resulting from the non-optimized scoping studies, attributed to preventable stresses such as shrinkage, temperature fluctuations, and/or action of solvent fluid. Subsequent profiles in the figure for oxygen and silicon are due to presence of these elements in the OSG substrate.

Example 3

Deposition of Tantalum Films of the Invention Yielding Binary, Ternary, and Higher-order Layered Composites) [2]

Example 3 details experiments testing suitability of deposition methods of the invention for producing binary, ternary, and higher-order layered composites in conjunction with various deposition methods known in the art, e.g., PVD, sputter deposition, ALD, and CVD.

In a first experiment, a tri-layer metal film and multilayer composite was prepared as follows. An OSG substrate coated with a ruthenium surface by conventional sputter deposition (i.e., PVD) was placed in a deposition vessel, (i.e., OSG/PVD-$Ru^0$). Next, a tantalum metal film was deposited in accordance with the invention to the ruthenium surface using a tantalum metal precursor [(In)Ta$(CO)_4$] solution introduced into a carbon dioxide solvent fluid as described herein, yielding a bi-layer metal (PVD-$Ru^0$/CFD-$Ta^0$) film and multilayer (e.g., tertiary) composite (OSG/PVD-$Ru^0$/CFD-$Ta^0$). Next, a ruthenium film (i.e., CFD-$Ru^0$) was deposited as detailed in Example 2 as a "cap" layer, preventing oxidation of the tantalum metal film, and yielding a tertiary metal film (PVD-$Ru^0$/CFD-$Ta^0$/CFD-$Ru^0$) and multilayer (OSG/PVD-$Ru^0$/CFD-$Ta^0$/CFD-$Ru^0$) composite. Conditions are listed in Table 6. Higher order films and/or composites may be prepared similarly. Further, "cap" layers of various thicknesses may be applied using processes described herein. No limitations are thus intended.

TABLE 6

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent$^{\Delta\Delta}$ |
|---|---|---|---|---|---|---|
| $(In)Ta(CO)_4$ | OSG/PVD-$Ru^0$ | $CO_2$ | ~350 | ~110 | 50 | — |
| $Ru_3(CO)_{12}$ | OSG/PVD-$Ru^0$/CFD-$Ta^0$ | $CO_2$ | ~325 | ~110 | — | 1 mL Acetone |

*organosilane glass (OSG). Constituents listed L to R beginning from innermost layers or surfaces to outermost layers or surfaces on the substrate.
$^{\Delta\Delta}$Acetone not required if solvent fluid sufficiently scrubbed of oxidizing (e.g., $O_2$) species.

Figure 6:
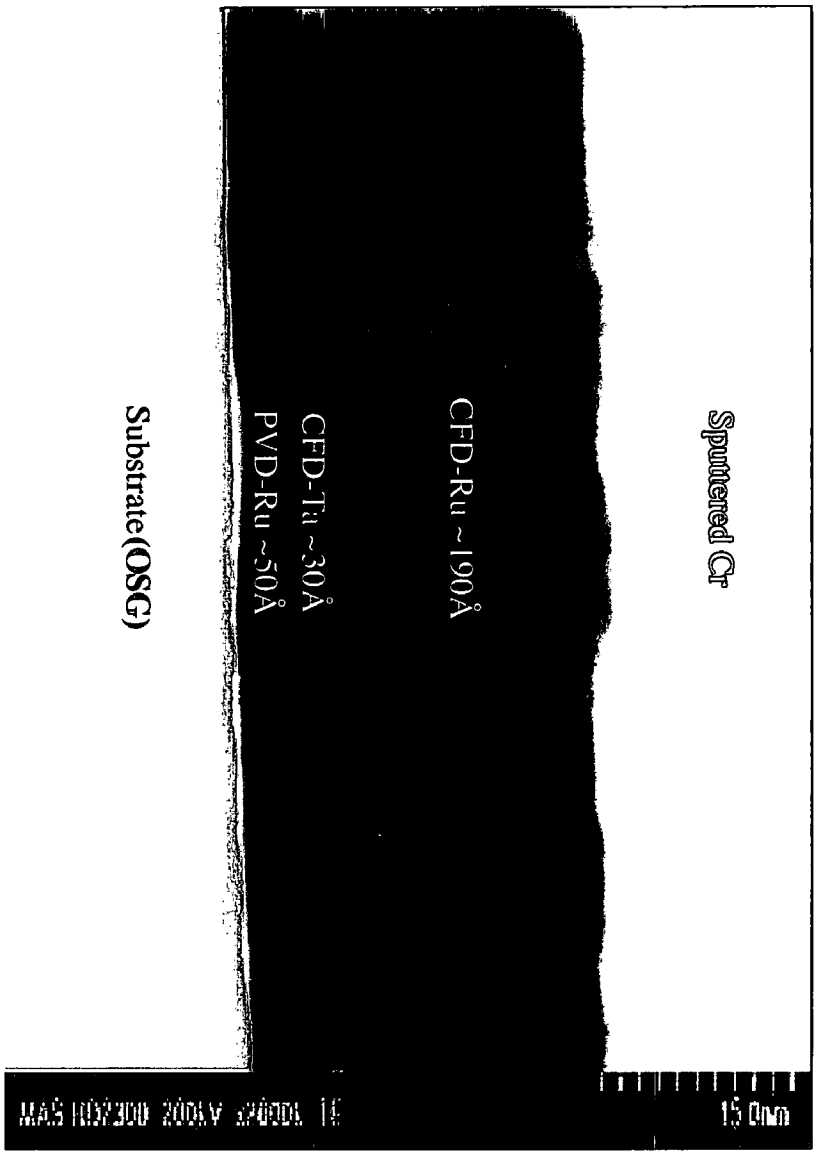
FIG. 6 is a transmission electron micrograph (TEM) of a cross-section of a composite substrate showing layers thereof, including a tantalum metal layer deposited in accordance with the invention.

FIG. 6 is a transmission electron micrograph (TEM) of a cross-section of the resulting composite comprising the tri-layer (PVD-$Ru^0$/CFD-$Ta^0$/CFD-$Ru^0$) metal film. In the figure, the tantalum film layer (~30 Å) deposited in accordance with the invention is disposed between the first PVD ruthenium layer and the subsequent (CFD-$Ru^0$) ruthenium layer, consistent with the deposition steps utilized in the experiment. A layer of chromium (Cr) metal was sputter deposited prior to analysis to stabilize deposition layers and to distinguish layer thicknesses. Results show processes of the present invention are compatible with deposition methods known in the art, e.g., for fabricating various composites. Shading and/or color differences observed in the TEMs for films deposited in accordance with the invention further indicate that various properties of individual layers may be qualitatively assessed. For example, color and/or shading differences observed for tantalum metal films in separate TEM scans suggest a greater electron density (density) for layers of an identical material having a darker color. Such differences can provide for control and/or assessment of process parameters of deposited metal films, e.g., during manufacturing. No limitations are intended.

In another experiment, a bi-layer metal film and a ternary composite was prepared as follows. First, an OSG substrate having a PVD ruthenium surface prepared as described herein in reference to Example 3 was placed in the deposition vessel. A tantalum metal film was deposited to the PVD ruthenium surface using a tantalum metal precursor [$(In)Ta(CO)_4$] solution introduced in a carbon dioxide solvent fluid in accordance with the invention, yielding a (PVD-$Ru^0$/CFD-$Ta^0$) bi-layer film and ternary composite (OSG/PVD-$Ru^0$/CFD-$Ta^0$). Conditions are listed in Table 7.

TABLE 7

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent |
|---|---|---|---|---|---|---|
| $(In)Ta(CO)_4$ | OSG/PVD-$Ru^0$ | $CO_2$ | ~350 | ~115 | 50 | — |

*organosilane glass (OSG). Constituents listed L to R beginning from innermost layers or surfaces to outermost layers or surfaces on the substrate.

Figure 7:
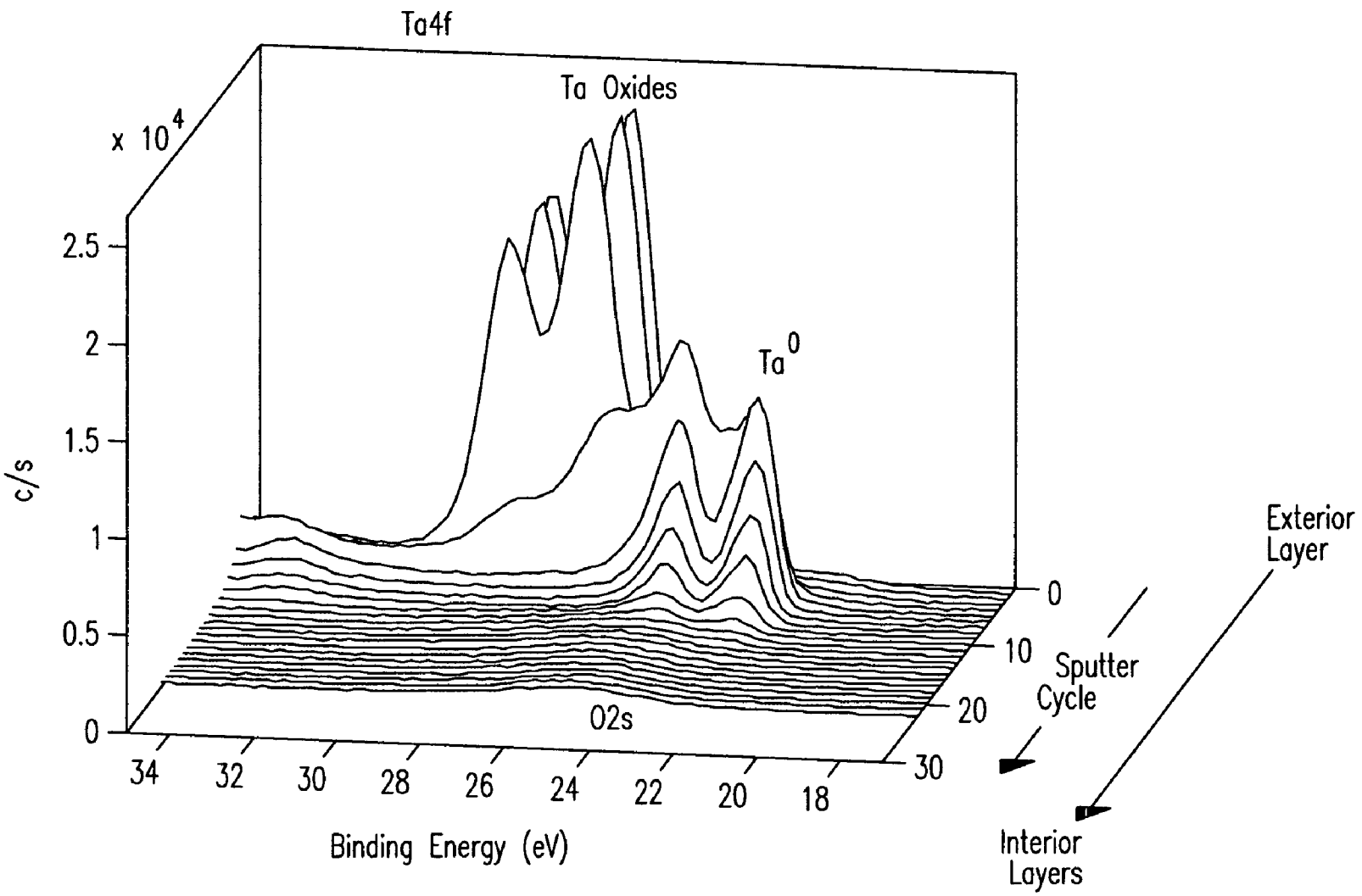
FIG. 7 is a plot from XPS analysis of a bi-layer metal film comprising a tantalum layer deposited in accordance with the invention atop a PVD ruthenium layer on an OSG substrate, according to another embodiment of the invention. Oxidation state of the tantalum film layer as a function of tantalum depth on the substrate is illustrated.

FIG. 7 is a plot (count rate vs. binding energy vs. sputtering cycle) from XPS analysis of a bi-layer metal film (PVD-$Ru^0$/CFD-$Ta^0$) comprising a tantalum layer deposited in accordance with the invention atop a PVD ruthenium layer on an OSG substrate, according to another embodiment of the invention. Oxidation state of the tantalum film layer as a function of tantalum depth on the substrate is illustrated. The tantalum film and layer was deposited at liquid, near-critical, or supercritical conditions from the mixed precursor solution in accordance with the invention. Results show Ta metal (reduced) is present in the film, indicating successful deposition to the substrate surface. In the figure, peaks corresponding to presence of tantalum oxide ($Ta_2O_5$) are also observed.

Figure 8:
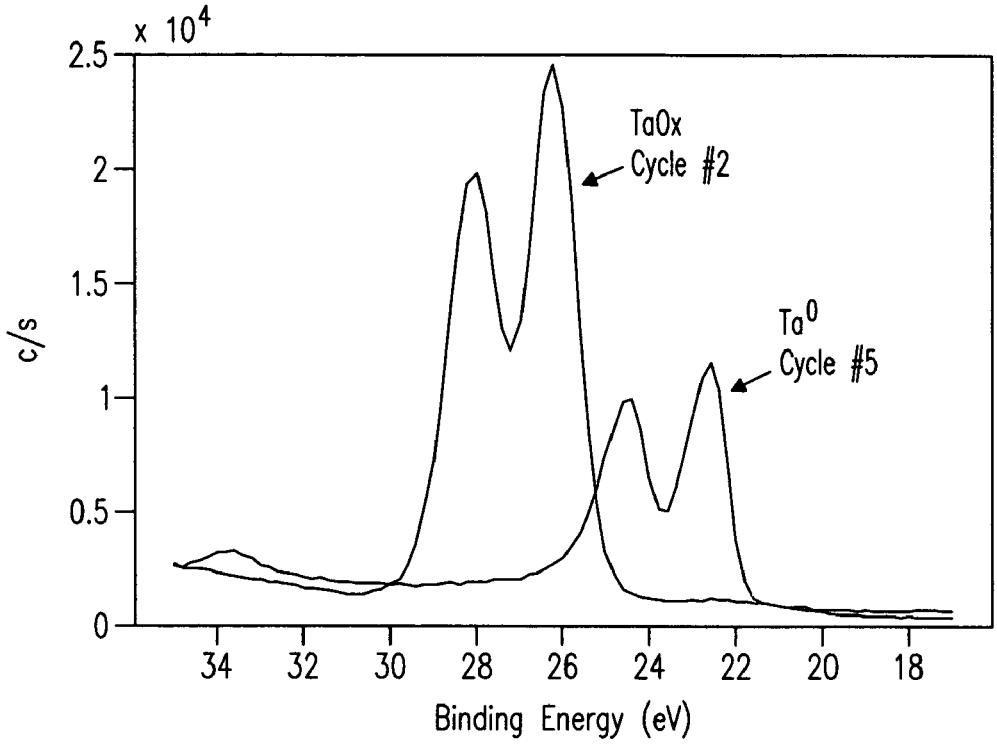
FIG. 8 shows high resolution Ta 4f XPS peak data for sputtering cycles 2 and 5 of FIG. 7, respectively, showing transition of tantalum in the oxide form to tantalum in the reduced form of the tantalum metal film deposited in accordance with the invention.
Figure 9:
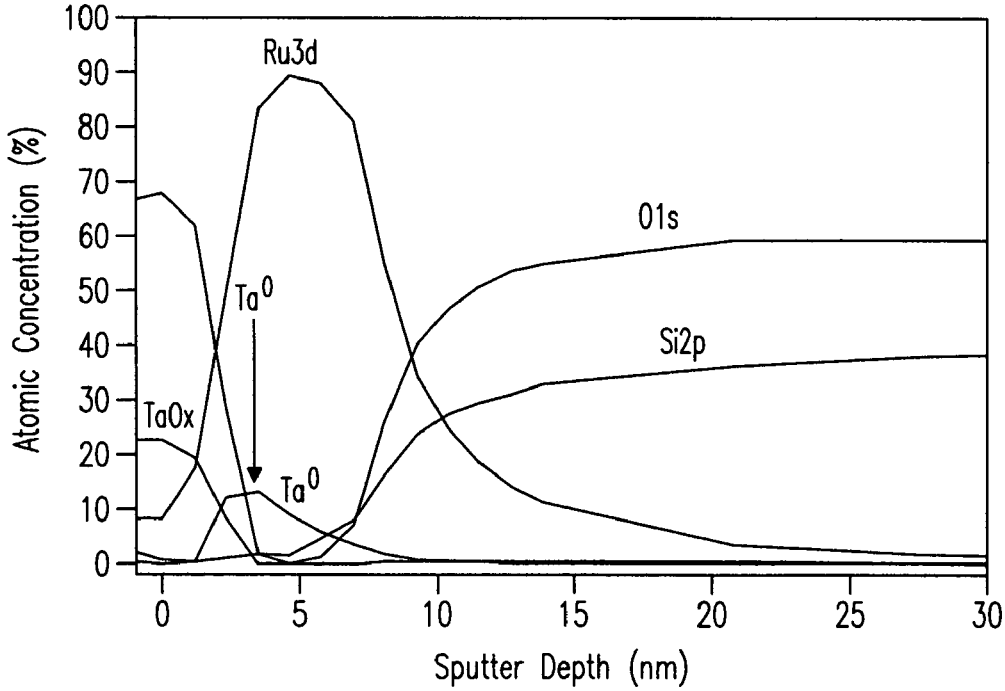
FIG. 9 is an XPS depth profile plot corresponding to the metal film of FIG. 7, showing atomic composition of the film layers on the surface of the substrate as a function of depth.

FIG. 8 shows high resolution Ta 4f XPS peak data for depth profile sputtering cycles 2 and 5 of FIG. 7, respectively, showing the transition from tantalum in the oxide form to the tantalum in the reduced metal film. FIG. 9 presents corresponding depth profile data (atomic concentration vs. sputter time). Here, the peak maximum for the Ta metal film profile preceeds the peak maximum for the ruthenium (Ru) profile, consistent with the sequence of deposition steps performed.

Results again show tantalum metal films can be selectively applied to a surface or substrate yielding desired multilayer composites. Subsequent oxygen and silicon profiles in the figure are due to presence of these elements in the base OSG substrate.

Example 4

Deposition of Tantalum Films of the Invention Yielding Binary, Ternary, and Higher-order Layered Composites [3]

Example 4 details experiments showing deposition of tantalum metal films of the invention and of other metals (e.g. Cu) in conjunction with deposition methods known in the art (e.g., PVD or CVD), yielding composite structures comprised of different multilayer films.

In one experiment, a tantalum metal film was deposited in accordance with the invention to a PVD-ruthenium coated OSG substrate (OSG/PVD-$Ru^0$) as described in Example 3. The coated substrate was placed on a heating stage and introduced to a high pressure vessel. Deposition of the tantalum film was effected as follows. Vessel was pressurized with 100 psi (6.80 atm) hydrogen to a total pressure of 1100 psi (74.85 atm) with carbon dioxide ($CO_2$) as the solvent fluid. ~25 mg to ~80 mg of a tantalum metal precursor, $(Cp)Ta(CO)_4$, premixed in $CO_2$ solvent was introduced to the vessel forming the mixed precursor solution. Conditions are listed in Table 8.

TABLE 8

Precursors and solution conditions for deposition of tantalum metal films on substrates.

| Precursor | Substrate* | Solvent Fluid | Stage (° C.) | Precursor Solution$^{\Delta}$ (° C.) | $H_2$ (psi) | Other Reagent |
|---|---|---|---|---|---|---|
| $(Cp)Ta(CO)_4$ | OSG/PVD-$Ru^0$ | $CO_2$ | ~350 | ~130 | 100 | — |

*organosilane glass (OSG). Constituents listed L to R beginning from innermost layers or surfaces to outermost layers or surfaces on the substrate.
$^{\Delta}$Temperature of solvent fluid at time of deposition following injection of 0.25 mL, 0.50 mL, or 1.0 mL of premixed liquid precursor prepared in $CO_2$.

Figure 10:
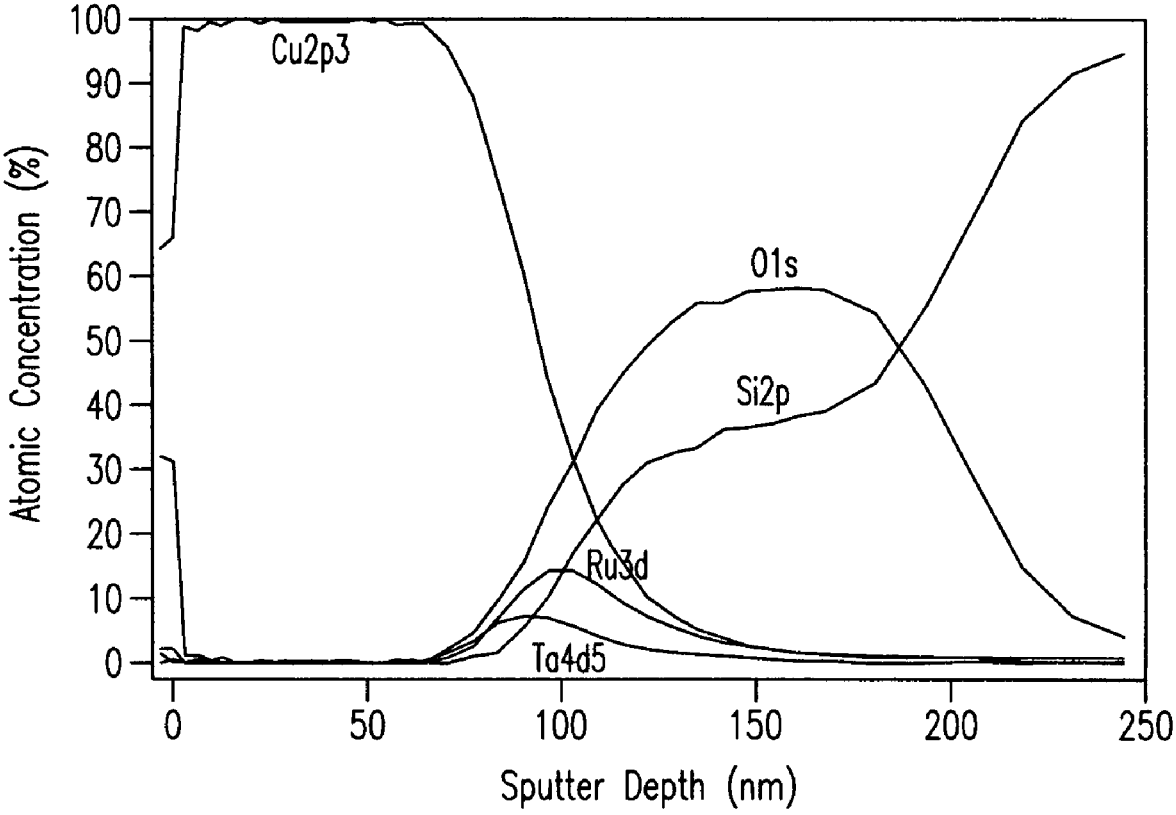
FIG. 10 presents XPS analysis data profiling a metal film layer deposited to a substrate, according to another embodiment of the process of the invention.

A copper metal film was subsequently deposited to the resulting (OSG/PVD-$Ru^0$/CFD-$Ta^0$) composite as described in pending U.S. application patent application Ser. No. (11/096,346), yielding a tri-layer metal film and multilayer (OSG/PVD-$Ru^0$/CFD-$Ta^0$/CFD-$Cu^0$) composite. Higher order films may be constructed similarly. FIG. 10 presents XPS depth profile data (atomic concentration vs. sputter depth) showing composition of the film layers of the resulting (OSG/PVD-$Ru^0$/CFD-$Ta^0$/CFD-$Cu^0$) composite. Results show the presence of both reduced copper ($Cu^0$), reduced tantalum ($Ta^0$), and reduced ruthenium ($Ru^0$) metals associated with deposition of the tri-layer metal film to the substrate. In practical application, deposition of various metals (e.g., Cu on Ta, or Ru on Ta) can be used, e.g., for protection of an exposed metal film or surface layer against oxidation, or for other uses including, but not limited to, e.g., deposition of seed layers for use in semiconductor fabrication. As demonstrated herein, the invention is suitable for use with conventional deposition methods, e.g., for production of multilayer composites and structures. No limitations are intended.

Example 5

Figure 11A:
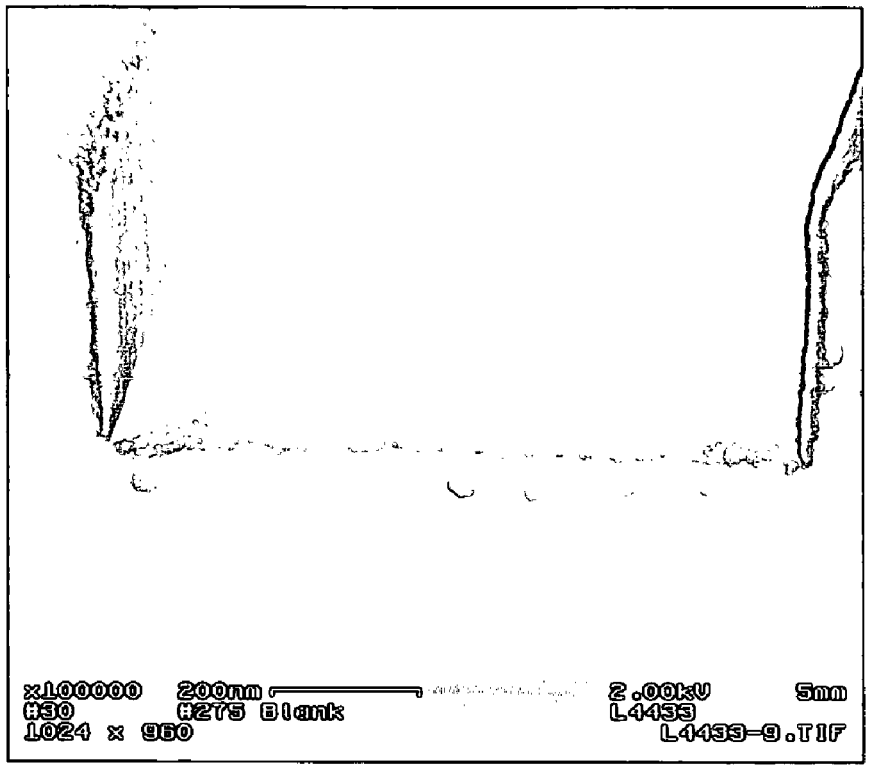
FIGS. 11*a*-11*b* are Scanning Electron Micrographs (SEMS) of feature pattern substrates at 200 nm and 500 nm resolutions, respectively, prior to deposition of tantalum films of the invention.
Figure 11B:
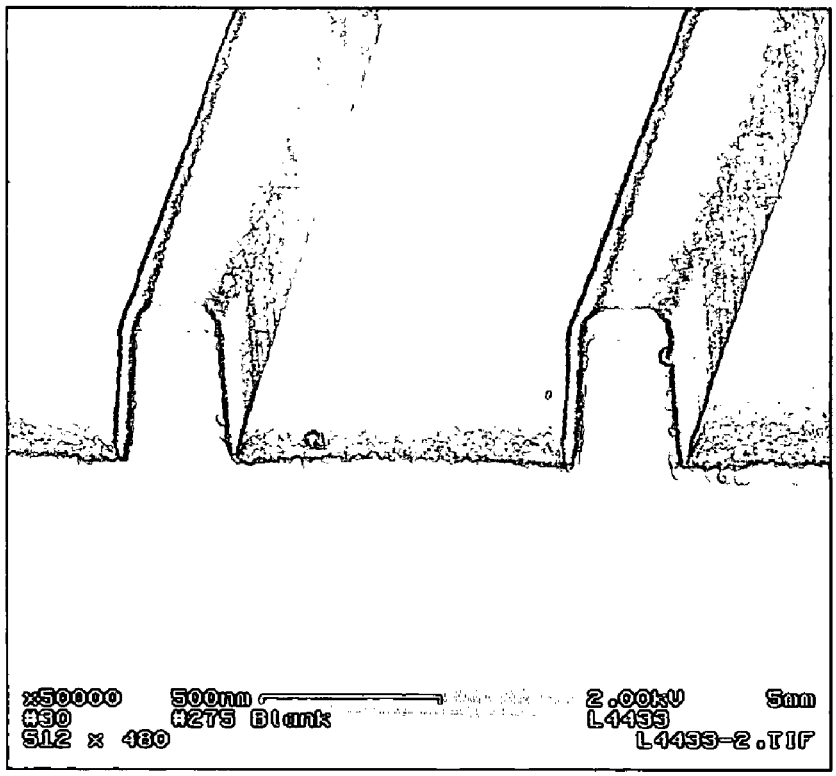

Deposition of Tantalum Films of the Invention to Pattern Surfaces and Substrates Yielding Multilayered Feature Composites Example 5 describes experiments demonstrating suitability of the deposition methods of the invention to substrates having complex feature patterns, e.g., trenches. An OSG substrate having feature trenches coated with a conventional PVD-Ta layer (125 Å), a conventional PVD-Ru layer (50 Å) and a conventional PVD-TaN layer (125 Å) was placed in a pressure vessel. FIGS. 11*a*-11*b* present scanning electron micrographs (SEMS) of the feature substrate (i.e., OSG-trenches/PVD-$Ta^0$/PVD-$Ru^0$/PVD-TaN) prior to tantalum deposition at two different resolutions, 200 nm and 500 nm, respectively. A tantalum metal film was then deposited to the substrate in accordance with the invention atop the coated feature trenches using a tantalum metal precursor [(In)Ta$(CO)_4$] premixed in the solvent fluid and introduced to a pressure vessel, resulting in a structured composite, i.e., (OSG-trenches/PVD-$Ta^0$/PVD-$Ru^0$/PVD-TaN/CFD-$Ta^0$). A ruthenium film was subsequently deposited as detailed in Example 2, resulting in a multilayered metal film and feature composite, i.e., (OSG-trenches/PVD-$Ta^0$/PVD-$Ru^0$/PVD-TaN/CFD-$Ta^0$/CFD-$Ru^0$). Conditions are listed in Table 9.

TABLE 9

Precursors and solution conditions for deposition of Tantalum metal films on substrates.

| Precursor | Substrate* | Solvent Fluid | Stage (° C.) | Precursor Solution (° C.) | $H_2$ (psi) | Other Reagent$^{\Delta\Delta}$ |
|---|---|---|---|---|---|---|
| (In)Ta$(CO)_4$ | OSG-trenches/ PVD-$Ta^0$/PVD-$Ru^0$/ PVD-TaN | $CO_2$ | ~350 | ~110 | 50 | — |
| $Ru_3(CO)_{12}$ | OSG-trenches/ PVD-$Ta^0$/PVD-$Ru^0$/ PVD-TaN/CFD-$Ta^0$ | $CO_2$ | ~325 | ~110 | — | 1 mL Acetone |

*organosilane glass (OSG). Constituents listed L to R beginning from innermost layers or surfaces to outermost layers or surfaces on the substrate.
$^{\Delta\Delta}$Acetone not required if solvent fluid sufficiently scrubbed of oxidizing (e.g., $O_2$) species.

Figure 11C:
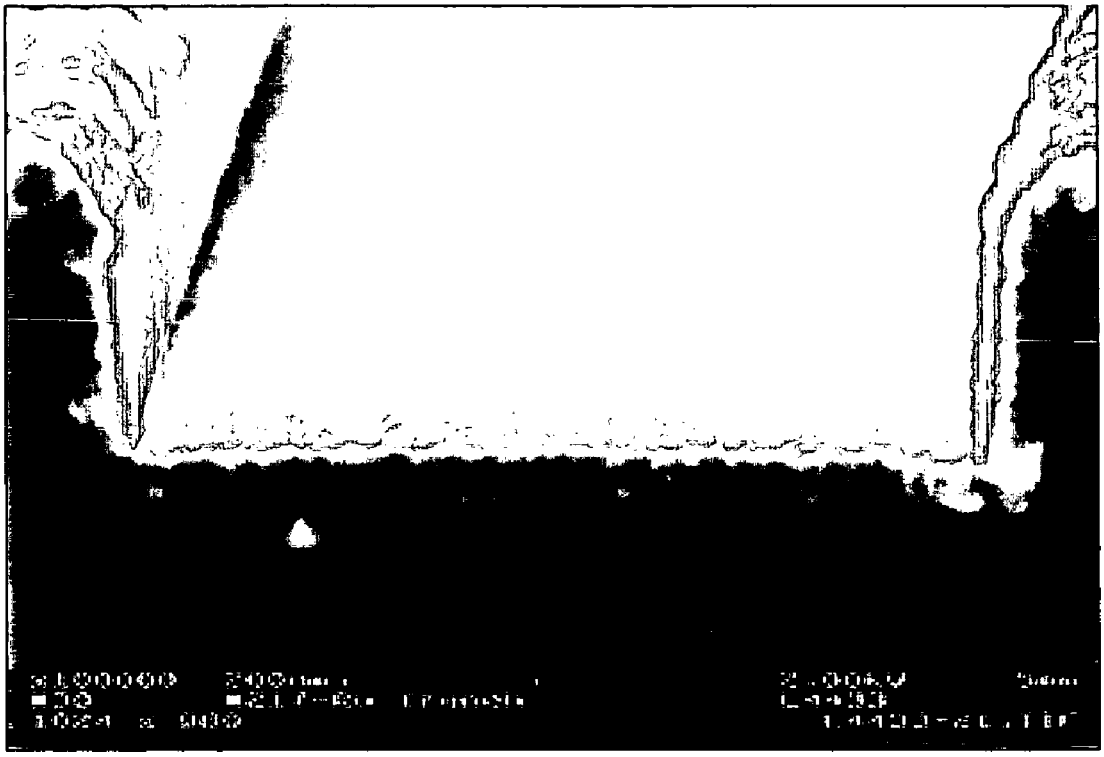
FIGS. 11*c*-11*d* are SEMS of feature pattern substrates following deposition of tantalum, and other metal films thereto, at 200 nm and 500 nm resolutions, respectively, according to another embodiment of the process of the invention.
Figure 11D:
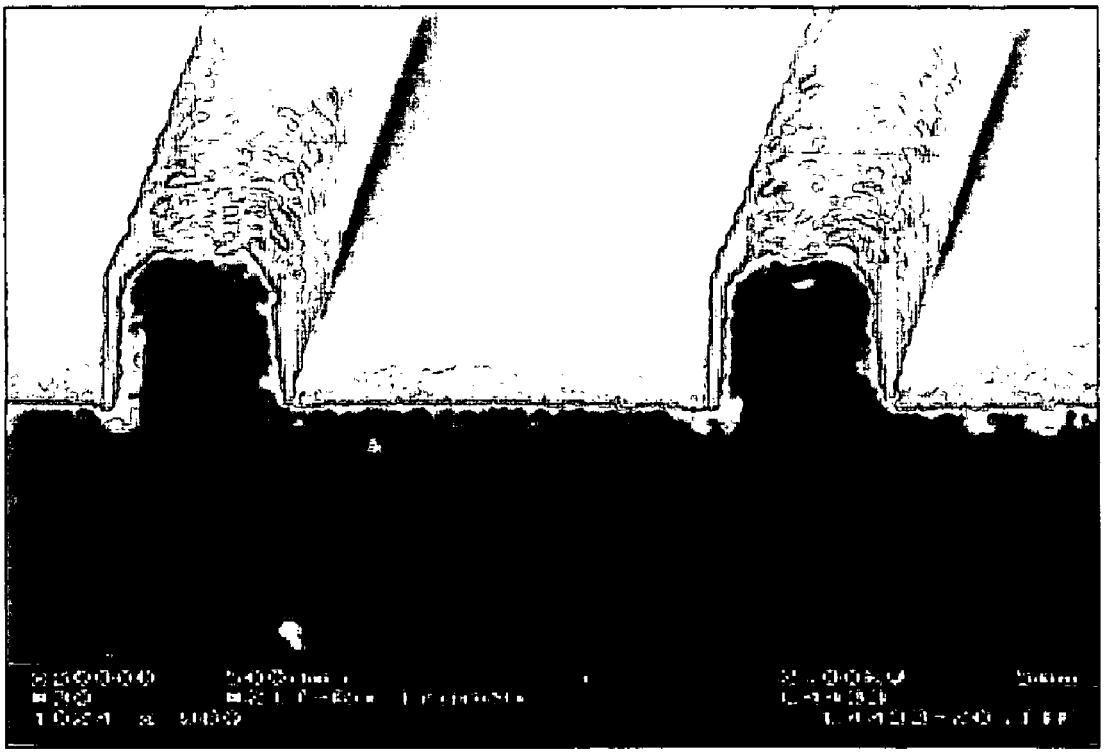

FIGS. 11*c*-11*d* present SEMS of the resulting feature composite (OSG-trenches/PVD-$Ta^0$/PVD-$Ru^0$/PVD-TaN/CFD-$Ta^0$/CFD-$Ru^0$) at 200 nm and 500 nm, respectively, showing metal films deposited thereto, according to another embodiment of the invention. At the current contrast, the conformal tantalum layer (i.e., CFD-$Ta^0$) deposited in accordance with the invention is not distinguished from the ruthenium layer (CFD-$Ru^0$) deposited subsequently. Thickness of the substrate layers before and after deposition of tantalum (i.e., CFD-$Ta^0$) and ruthenium (i.e., CFD-$Ru^0$) confirm the successful deposition of metal films in the multilayered, feature composite.

Results demonstrate potential for combining processes of the present invention with conventional deposition processes known in the art for fabricating composite structures with complex feature patterns and various multi-layer films.

Example 6

Figure 12:
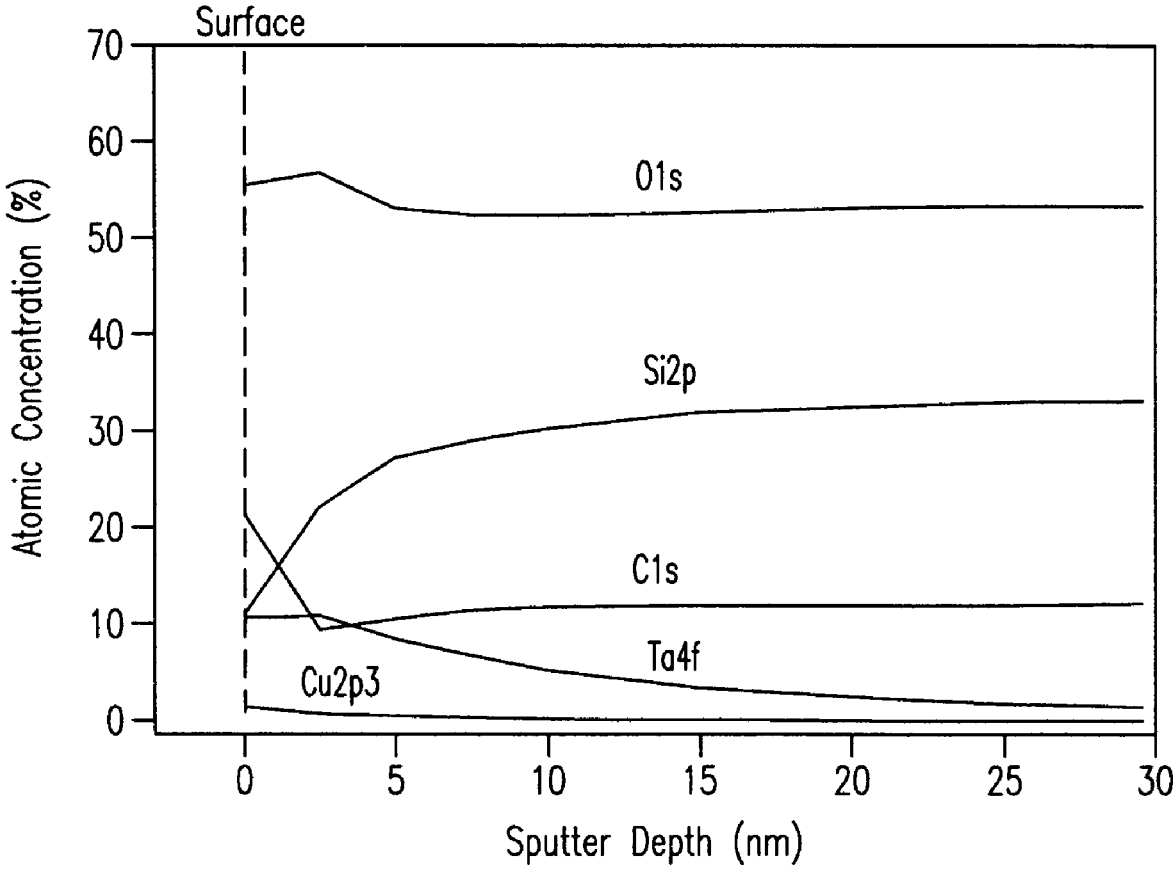
FIG. 12 is an XPS depth profile plot showing atomic composition of a tantalum metal film deposited to a ceramic coated substrate, according to another embodiment of the process of the invention.

Deposition of Tantalum Films of the Invention to Ceramic Coated Substrates Yielding Multilayered Composites Example 6 details preparation of a ceramic coated substrate in conjunction with deposition methods of the invention, yielding another multilayer composite. A tantalum metal film was deposited in accordance with the invention to an OSG substrate comprising a ceramic cap layer of, e.g., silicon carbide (SiC), forming an OSG/SiC/CFD-$Ta^0$ composite. A copper metal film was subsequently deposited on the tantalum layer as detailed in Example 5, yielding a bi-layer metal film (i.e., CFD-$Ta^0$/CFD-$Cu^0$), and a multilayered composite (i.e., OSG/SiC/CFD-$Ta^0$/CFD-$Cu^0$). FIG. 12 presents XPS depth profile data (atomic concentration vs. sputter depth) showing composition of the various layers of the resulting (OSG/SiC/CFD-$Ta^0$/CFD-$Cu^0$) composite. Results are consistent with the deposition sequence used, showing presence of both reduced Cu metal and reduced Ta metal associated with the bi-layer metal films deposited to the substrate, as well as the underlying carbon (C) and silicon (Si) associated with the SiC cap layer and the oxygen associated with the OSG oxide substrate.

Deposition of various metals (e.g., Cu on Ta, or Ru on Ta) and cap layers (e.g., SiC on Ta) can be used, e.g., for protecting the exposed metal films to oxidation, or for other uses including, but not limited to, e.g., deposition of seed layers (metal films) for use in semiconductor fabrication. As discussed herein, the invention is suitable for use with conventional deposition methods in production of multilayer composites and structures. No limitations are intended.

As shown herein, methods of the present invention for depositing tantalum metal films can be used in conjunction with deposition processes known in the art including, but not limited to, e.g., sputtering, PVD, CVD, and like deposition methods for producing multilayer films and composites.

CLOSURE

Selective deposition in accordance with the invention offers enhancements and/or alternatives for surface processing related to manufacturing and/or fabrication of substrates, e.g., semiconductor chips and related applications including, but not limited to, e.g., composite fabrication. Metal film deposition described herein is facilitated by use of low valence state tantalum precursors. Ability to easily deposit thin, pure reduced metal tantalum films under conditions suitable for use in conjunction with various liquid, near-critical, and supercritical fluids has myriad potential applications in metal film deposition processes known to those of skill in the art. The invention encompasses selective deposition of materials, as described herein, e.g., for use in producing composites comprising various metal films layers, useful, e.g., as barrier films in silicon wafer or semiconductor chip manufacturing. The invention is also useful in conjunction with deposition of tantalum metal films to various surfaces, including complex surfaces, e.g., for coating and filling. Deposition methods of the invention may be further used in conjunction with, or as an alternative to, processes including, but not limited to, Chemical Mechanical Planarization (CMP). No limitations are hereby intended.

While the present invention is described herein with reference to method(s), apparatus, system(s), and embodiments thereof, it should be understood that the invention is not limited thereto, and various alternatives in form and detail may be made therein without departing from the spirit and scope of the invention.

We claim:

1. A method, characterized by the step of:

exposing a near-critical or supercritical fluid containing a tantalum-releasing precursor to a wavelength of light preselected to release tantalum from said precursor;

whereby tantalum released from said precursor is deposited to a selected surface.

2. The method of claim 1, wherein said surface is a feature surface that includes a member selected from the group consisting of vias, wells, trenches, gaps, holes, interconnects, and combinations thereof.

3. The method of claim 1, wherein said surface is selected from the group consisting of two-dimensional surfaces, three-dimensional surfaces, and combinations thereof.

4. The method of claim 1, wherein said surface is in contact with said fluid.

5. The method of claim 1, wherein release of tantalum from said precursor is performed photolytically.

6. The method of claim 1, wherein the step of exposing said fluid to a wavelength of light includes use of a light source selected from the group consisting of: visible (VIS) sources, ultra-violet (UV) sources, ultra-violet/visible (UV/VIS) sources, laser sources, and combinations thereof.

7. The method of claim 1, wherein tantalum released from said precursor is deposited as a tantalum-containing film on said surface.

8. The method of claim 1, wherein said tantalum-containing film is used as a diffusion barrier during manufacture of microelectronic devices.

9. The method of claim 1, wherein said tantalum-containing film is used as a metal seed layer during manufacture of a semiconductor chip or wafer.

10. The method of claim 1, wherein said tantalum-containing film is used as a metal finish in a metal finishing process.

11. The method of claim 1, wherein said fluid includes a member selected from the group consisting of: carbon dioxide, ethane, ethylene, propane, butane, sulfur hexafluoride, ammonia, and combinations thereof.

12. The method of claim 11, further including the steps of premixing said precursor in a solvent and introducing same to said fluid prior to exposing said fluid to said wavelength of light.

13. The method of claim 11, wherein the step of exposing said fluid to a wavelength of light is performed below the thermal decomposition temperature of said precursor.

14. The method of claim 11, wherein the step of exposing said fluid to a wavelength of light includes exposing at least a portion of said fluid above the thermal decomposition temperature of said precursor.

15. The method of claim 11, wherein said fluid is comprised of carbon dioxide at a pressure selected in the range from about 830 psi (56.48 atm) to about 10,000 psi (680.46 atm); or from about 1500 psi (102.07 atm) to about 5,000 psi (340.23 atm); or from about 2250 psi (153.10 atm) to about 3,000 psi (204.14 atm).

16. The method of claim 1, wherein said tantalum-releasing precursor is a chemical compound of the form $[(Cp)(Ta)(CO)_{4-N}(L_N)]$ or $[(In)(Ta)(CO)_{4-N}(L_N)]$;

wherein (Cp) is a cyclopentadienyl ring or a cyclopentadienyl ring functionalized with up to 5 identical or different R-groups;

wherein (In) is an indenyl polycyclic hydrocarbon or substituted indenyl polycyclic hydrocarbon comprising up to 7 identical or different R-groups;

wherein (CO) is a number (4—N) of carbonyl ligands, where N is a number from 0 to 4; and wherein $(L_N)$ is a number (N) of from 0 to 4 identical or different ligands.

17. The method of claim 16, wherein said tantalum-bearing precursor is selected from the group consisting of $CpTa(CO)_4$, and $InTa(CO)_4$.

18. The method of claim 16, wherein said R-groups are selected from the group consisting of: H, alkyls, alkenyls, alkynyls, and combinations thereof.

19. The method of claim 1, wherein said surface is a surface of a microelectronic substrate.

20. The method of claim 19, wherein said microelectronic substrate is a semiconductor wafer, or a semiconductor chip.

21. The method of claim 1, wherein tantalum released from said precursor is deposited on a surface to obtain a binary, a tertiary, or a higher-order composite.

22. The method of claim 21, wherein said binary, tertiary, or higher-order composite includes a member selected from the group consisting of: OSG, Ru, $Ta_2O_5$, Ta, Cu, SiC, TaN, and combinations thereof.

23. The method of claim 1, wherein tantalum deposited as a tantalum-containing film on said surface is deposited using a reducing agent.

24. The method of claim 23, wherein said reducing agent is selected from the group consisting of: hydrogen, n-alkanols, and combinations thereof.

25. The method of claim 24, wherein said reducing agent is an n-alkanol selected from the group consisting of: methanol, ethanol, n-propanol, and combinations thereof.

26. The method of claim 1, wherein said surface is a surface of a substrate, said substrate is selected from the group consisting of: metal substrates, ceramic substrates, polymer substrates, and combinations thereof.

27. The method of claim 26, wherein said surface is a surface of a substrate, said substrate includes a member selected from the group consisting of: a ceramic, a metal, a polymer, a low-k dielectric, an organosilane glass, a siloxane, and combinations thereof.

28. The method of claim 27, wherein said ceramic member includes TaN and/or SiC.

29. The method of claim 27, wherein said siloxane member is a polysiloxane.

30. The method of claim 27, wherein said siloxane member includes methylsilsesquioxane.

31. The method of claim 1, wherein the step of exposing said fluid to a wavelength of light to release tantalum from said precursor includes the step of removing one or more photolabile ligands of said precursor in said fluid.

32. The method of claim 31, wherein the step of removing one or more photolabile ligands in said fluid includes ligands selected from the group consisting of: photolytically-releasable ligands, photolytically-exchangeable ligands, photolytically-sensitive ligands, and combinations thereof.

33. The method of claim 32, further including the step of replacing one or more photolabile ligands of said precursor with a different ligand while in said fluid to obtain at least partial release of tantalum at a different wavelength or photolytic energy.

34. The method of claim 33, wherein the step of replacing one or more photolabile ligands of said precursor while in said fluid includes replacing with an ethylene ligand.

35. The method of claim 33, wherein the step of replacing one or more photolabile ligands includes replacing one or more photolabile ligands of said precursor while in said fluid with a thermally labile ligand to obtain at least partial release of tantalum at or above the thermal decomposition temperature of said precursor.

36. The method of claim 35, wherein the step of replacing one or more photolabile ligands of said precursor with a thermally labile ligand while in said fluid provides for release of tantalum in a combined photolytic/thermal process.

37. The method of claim 36, further including the step of heating said fluid to remove said thermally labile ligand from said precursor.

38. The method of claim 37, wherein the step of heating said fluid to remove said thermally labile ligand from said precursor includes use of a source selected from the group consisting of: microwave sources, infra-red (IR) sources, radio-frequency (RF) sources, ultrasonic sources, chemical sources, and combinations thereof.

39. The method of claim 37, wherein the step of heating said fluid to remove said thermally labile ligand from said precursor includes a temperature up to about 350° C.; a temperature up to about 400° C.; or a temperature up to about 600° C.

* * * * *